US005389487A

United States Patent [19]

Kawakami et al.

[11] Patent Number: 5,389,487

[45] Date of Patent: Feb. 14, 1995

[54] IMAGE FORMING PROCESS, IMAGE-FORMING APPARATUS, APPARATUS UNIT, AND FACSIMILE APPARATUS

[75] Inventors: Hiroaki Kawakami; Shinji Doi, both of Kawasaki; Keita Nozawa; Masatsugu Fujiwara, both of Yokohama; Masashi Jimbo, Asaka, all of Japan

[73] Assignee: Canon Kabushiki Kaisha, Tokyo, Japan

[21] Appl. No.: 237,409

[22] Filed: May 3, 1994

Related U.S. Application Data

[63] Continuation of Ser. No. 120,849, Sep. 15, 1993, abandoned, which is a continuation of Ser. No. 799,328, Nov. 27, 1991, abandoned.

[30] Foreign Application Priority Data

| | | | |
|---|---|---|---|
| Nov. 29, 1990 | [JP] | Japan | 2-325532 |
| Feb. 8, 1991 | [JP] | Japan | 3-017644 |
| Feb. 28, 1991 | [JP] | Japan | 3-055568 |
| Mar. 8, 1991 | [JP] | Japan | 3-067753 |
| Apr. 5, 1991 | [JP] | Japan | 3-099747 |

[51] Int. Cl.[6] ..... G03G 13/08

[52] U.S. Cl. ..... 430/120; 430/126

[58] Field of Search ..... 430/107, 106, 109, 120, 430/126

[56] References Cited

U.S. PATENT DOCUMENTS

| | | | |
|---|---|---|---|
| 2,297,691 | 10/1942 | Carlson | 430/109 |
| 4,206,064 | 6/1980 | Kiuchi et al. | 430/106 |
| 4,403,027 | 9/1983 | Iskikawa et al. | 430/110 |
| 4,404,271 | 9/1983 | Kawagishi et al. | 430/110 |
| 4,893,151 | 1/1990 | Yamazaki et al. | 430/107 |
| 4,939,060 | 7/1990 | Tomiyama et al. | 430/111 |
| 5,071,918 | 12/1991 | Funato et al. | 430/109 |
| 5,079,125 | 1/1992 | Anno et al. | 430/109 |
| 5,130,219 | 7/1992 | Mori et al. | 430/111 |
| 5,135,833 | 8/1992 | Matsunaga et al. | 430/110 |

FOREIGN PATENT DOCUMENTS

| | | |
|---|---|---|
| 41-20153 | 11/1966 | Japan . |
| 42-1627 | 1/1967 | Japan . |
| 42-23910 | 11/1967 | Japan . |
| 42-27596 | 12/1967 | Japan . |
| 43-24748 | 10/1968 | Japan . |
| 44-6397 | 3/1969 | Japan . |
| 45-26748 | 9/1970 | Japan . |
| 50-133338 | 10/1975 | Japan . |
| 55-42752 | 11/1980 | Japan . |
| 58-7384 | 2/1983 | Japan . |
| 58-116559 | 7/1983 | Japan . |
| 58-41508 | 9/1983 | Japan . |
| 59-7384 | 2/1984 | Japan . |
| 60-120368 | 6/1985 | Japan . |
| 63-271371 | 11/1988 | Japan . |

*Primary Examiner*—John Goodrow

*Attorney, Agent, or Firm*—Fitzpatrick, Cella, Harper & Scinto

[57] ABSTRACT

An image forming process is disclosed which uses a non-magnetic one-component type developer comprising a finder resin and a releasing agent having specific properties. The developer has such advantages as being excellent in low-temperature fixability as well as anti-offset property.

75 Claims, 6 Drawing Sheets

IMAGE FORMING PROCESS, IMAGE-FORMING APPARATUS, APPARATUS UNIT, AND FACSIMILE APPARATUS

This application is a continuation of application Ser. No. 08/120,849, filed Sep. 15, 1993, now abandoned, which application is a continuation of application Ser. No. 07/799,328, filed Nov. 27, 1991, now abandoned.

BACKGROUND OF THE INVENTION

1. Field of the Invention

The present invention relates to an image forming process such as electrophotography, electrostatic recording, and electrostatic printing, in particular, to an image forming process which employs non-magnetic one-component type developer, and also relates to an image forming apparatus, an apparatus unit, and a facsimile apparatus.

2. Related Background Art

Many electrophotographic processes are already known as described in U.S. Pat. No. 2,297,691, and Japanese Patent Publication Nos. 42-23910 and 43-24748. Generally in these methods, an electric latent image is formed on a photosensitive member by utilizing a photoconductive substance and developed with a toner, and then, the toner image is transferred if necessary onto an image-receiving medium like paper, and fixed by heating, pressing, hot-pressing, or solvent-vapor treatment to obtain a copy. The untransferred toner which remained on the photosensitive member was cleaned, and the above steps are repeated.

In recent years, such types of copying apparatuses have come into use not only for business copying machines for copying an original but also for printers for output of computers, and personal copying machines.

For this reason, such properties as compact size, light weight and small power-consumption are required for copying apparatus. Consequently, copying apparatus has come to consist of simpler elements in many respects. To developed electrostatic latent images, two-component developing methods and one-component developing methods are known widely. In the two-component developing methods, a mixture of a toner and a carrier is used, and in the one-component developing methods, a magnetic toner only is used. The two-component developing method cannot meet the requirements for smaller size and light weight because it employs a carrier and an ATR mechanism for controlling the mixing ratio of the toner and the carrier is necessary. The one-component developing methods have disadvantages owing to difficulty in application to color toners because the methods use a magnetic toner.

On the other hand, Japanese Laid-Open Patent Application Nos. 58-116559, 60-120368, and 63-271371 disclose non-magnetic one-component developing methods which is a noteworthy method to solve the above problems.

In the non-magnetic one-component developing methods, a developer is applied on a developer-carrying member by use of a layer thickness-controlling means such as a blade. The developer is electrostatically charged by the friction with the blade or the surface of the developer-carrying member. However, if the applied layer of the developer is excessively thick, some portion of the developer is not sufficiently electrically charged, which may cause fogging or black spots around the line image. Therefore, the developer should be applied in a thin layer. For this reason, the blade has to be pressed against the developer-carrying member with a sufficiently large pressure, thereby the developer receives greater force than the developer in a two-component developing method or a one-component developing method employing a magnetic toner. Thus, in such a method, the developer is liable to deteriorate, causing poor image quality such as fogging or low density.

The developer employed for a non-magnetic one-component developing method is required to have a high mechanical strength and a high thermal strength. However, if these strengths are simply increased, they result in increase of the heat energy consumed for fixation, which is contrary to the low power-consumption requirement.

As described above, further improvement is required for the non-magnetic one-component developing method to achieve high developability, fixability, and anti-offset property.

SUMMARY OF THE INVENTION

An object of the present invention is to provide an image forming process, an image forming apparatus, an apparatus unit, and a facsimile apparatus, employing a non-magnetic one-component type developer which is free from the above problems.

Another object of the present invention is to provide an image forming process, an image forming apparatus, an apparatus unit, and a facsimile apparatus, employing a non-magnetic one-component type developer which is capable of giving high image density and does not cause deterioration of image such as fogging.

A further object of the present invention is to provide an image forming process, an image forming apparatus, an apparatus unit, and a facsimile apparatus, employing a non-magnetic one-component type developer which is satisfactory in anti-offset property, fixable at a sufficient low temperature, and applicable to low power-consuming fixation.

According to an aspect of the present invention, there is provided an image forming process comprising: a step of feeding a developer from a feeding roller onto a developer-carrying member, a step of applying the developer onto the developer-carrying member in a predetermined layer thickness by pressing the developer against the developer-carrying member with a blade and also giving an electrostatic charge to the developer by friction, a step of developing an electrostatic image formed on a latent-image holding member with the developer applied on the developer-carrying member, a step of transferring the developed image onto a recording medium, and a step of fixing the transferred image on the recording medium by action of heat and pressure:

wherein said developer is a non-magnetic one-component type developer comprising non-magnetic toner, the non-magnetic toner containing at least a binder resin and a releasing agent; the binder resin having a THF-soluble portion and less than 10% by weight of a THF-insoluble portion based on the binder resin, the THF-soluble portion having a molecular weight distribution curve pattern determined by GPC (gel permeation chromatography) in which a ratio of weight-average molecular weight/number-average molecular weight (Mw/Mn) is not less than 8 and at least one peak at MA(molecular weight range of $3.0\times10^3$–$4.5\times10^4$)

and at least one peak at MB (molecular weight range of $3.8\times10^5$–$1.0\times10^6$) and a local minimum at Md ($4.5\times10^4$–$3.8\times10^5$) are present, and MB/MA is from 10 to 150, and the ratio of SA:SB:Sd is 1:(0.2–0.7):(0.2–0.8) where SA is the area under the molecular weight distribution curve at the molecular weight range from 400 to Md, SB is the area under the molecular weight distribution curve at the molecular weight range of Md to $5.0\times10^6$, and Sd is the area surrounded by the molecular weight distribution curve and the straight line drawn from the peaktop at MA to the peaktop at MB; and the releasing agent has a number-average molecular weight of not higher than $3.0\times10^3$ a weight average molecular weight of not higher than $1.2\times10^4$, and a ratio of weight-average molecular weight-/number average molecular weight of not more than 4, and has a melting point of from 60° to 150° C., and is contained in the non-magnetic toner in an amount of from 0.1 to 20% by weight based on the binder resin.

According to another aspect of the present invention, there is provided an image forming apparatus comprising: a latent-image holding member, a developer-carrying member, a feeding roller for feeding a developer to the developer-carrying member, a developer applying blade provided downstream of the developer-carrying member, said blade and feeding roller being set to press against the developer-carrying member, a transfer means for transferring a developed image formed by a developer according to a latent image on the image-holding means to a recording medium, and a fixing means for fixing the unfixed tranferred image on the recording medium by action of heat and pressure, wherein the developer is the non-magnetic one-component type developer as defined above.

According to a further aspect of the present invention, there is provided an apparatus unit comprising: a latent image holding member for supporting an electrostatic latent image and a developing means for developing the electrostatic latent image supported on the latent image holding member with a developer, combined in one unit to be detachable from an apparatus main body, said unit having a developer-carrying member, a feeding roller for feeding a developer to the developer-carrying member, a developer applying blade provided downstream of the developer-carrying member, said blade and feeding roller being set to press against the developer-carrying member, a transfer means for transferring a developed image formed by a developer according to a latent image on the image-holding means to a recording medium, and a fixing means for fixing the unfixed tranferred image on the recording medium by action of heat and pressure, wherein the developer is the non-magnetic one-component type developer as defined above.

According to still another aspect of the present invention, there is provided a facsimile apparatus comprising an information-receiving means for receiving image information from a remote terminal and an electrophotographic apparatus having a latent image holding member for supporting an electrostatic latent image, a developer-carrying member, a feeding roller for feeding a developer to the developer-carrying member for carrying a developer, a developer applying blade provided downstream of the developer-carrying member, said blade and feeding roller being set to press against the developer-carrying member, a transfer means for transferring a developed image formed by a developer according to a latent image on the image-holding means to a recording medium, and a fixing means for fixing the unfixed tranferred image on the recording medium by action of heat and pressure, wherein the developer is the non-magnetic one-component type developer as defined above.

DESCRIPTION OF THE PREFERRED EMBODIMENT

Figure 1:
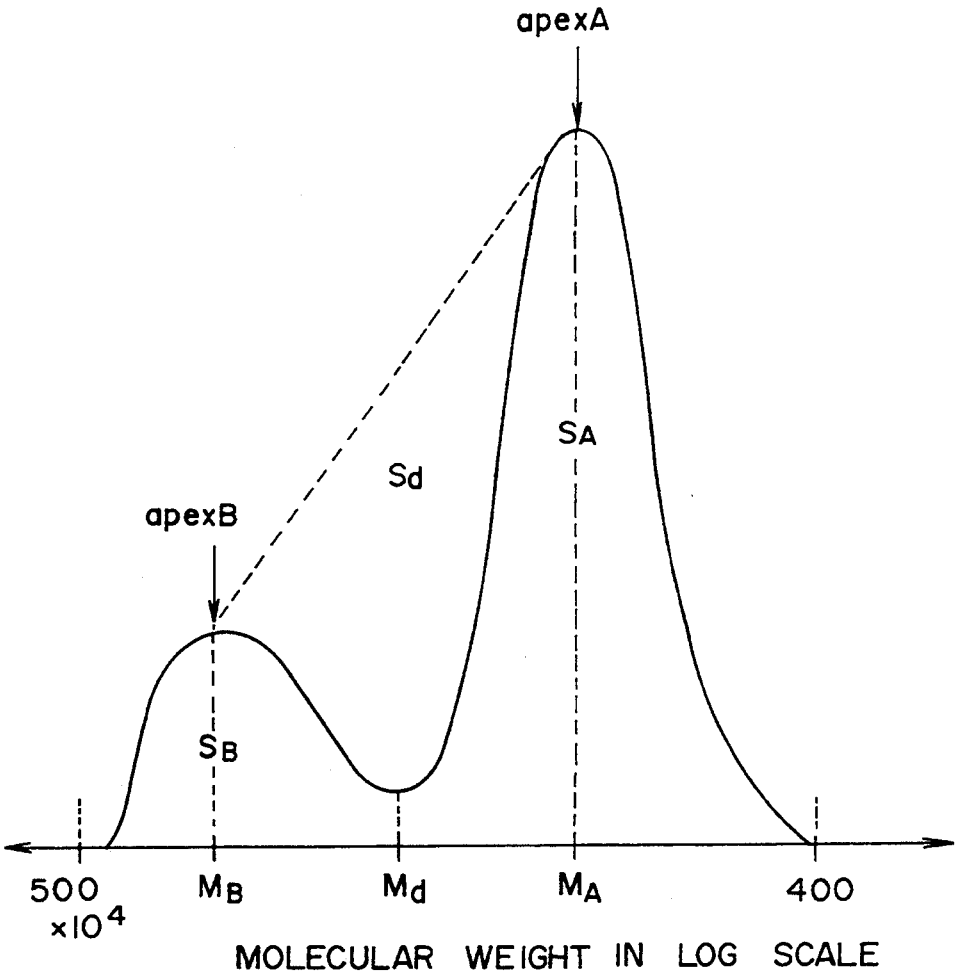
FIG. 1 is a drawing, explaining a molecular weight distribution curve derived by GPC.

The inventors of the present invention made comprehensive investigation to accomplish the aforementioned objects. Consequently, the inventors have found that the above objects are accomplished by employing a process comprising a step of feeding a developer from a feeding roller onto a developer-carrying member, a step of applying the developer onto the developer-carrying member in a predetermined layer thickness by pressing the developer against the developer-carrying member with a blade and simultaneously giving an electrostatic charge to the developer by friction between the developer particles, a step of forming a developed image by developing an electrostatic image formed on a latent-image holding member with the developer, a step of transferring the developed image onto a recording medium, and a step of fixing the transferred developed image on the recording medium, if the developer employed is a non-magnetic one-component type developer comprising non-magnetic toner, a binder resin contained in the non-magnetic toner has a THF-soluble portion and less than 10% by weight of a THF-insoluble portion based on the binder resin, the THF-soluble portion, according to GPC (gel permeation chromatography) molecular weight distribution determination, has a specified profile of molecular weight distribution, and the non-magnetic toner contains a releasing agent having a specified properties in a specified amount.

The present invention is described in detail below.

The non-magnetic one-component type developer of the present invention comprises a toner containing at least a binder resin and a releasing agent, and the binder resin contains a THF-soluble portion and a THF-insoluble portion. The THF-insoluble portion is less than 10% by weight, preferably 5% by weight or less, based on the binder resin. The THF-insoluble portion content of 10% by weight or higher is undesirable, because, at the higher content, melt viscosity in melt-kneading becomes excessively high in toner preparation, giving a high load to the resin and causing scission of the resin molecule, lowering the grinding efficiency in grinding step,and causing inconvenience in production. The THF-insoluble portion content in the toner should not be higher than 30% by weight, preferably is not higher the 10% by weight.

It is required that the THF-soluble portion posseses a molecular weight distribution curve pattern determined by GPC (gel permeation chromatography) in which a ratio of weight-average molecular weight/number-average molecular weight (Mw/Mn) is not less than 8 and at least one peak at MA(molecular weight range of $3.0\times10^3$–$4.5\times10^4$) and at least one peak at MB (molecular weight range of $3.8\times10^5$–$1.0\times10^6$), and a local minimum at Md ($2.0\times10^4$–$3.8\times10^5$) are present, and MB/MA is in the range of from 10 to 150, and the ratio of SA:SB:Sd is 1:(0.2–0.7):(0.2–0.8) where SA is the area under the molecular weight distribution curve at the molecular weight region of from 400 to Md; SB is the area under the molecular weight distribution curve at the molecular weight range of Md to $5.0\times10^6$; and Sd is the area surrounded by the straight line drawn from the apex of MA to the apex of MB and the molecular distribution curve. If the above conditions are not satisfied, the object of the present invention cannot be accomplished.

FIG. 1 is a drawing explaining a molecular weight distribution curve determined by GPC.

The ratio of weight-average molecular weight/number-average molecular weight (Mw/Mn) of the THF-soluble portion is not lower than 8, preferably not lower than 12, more preferably not lower than 18, further more preferably in the range of from 25 to 60. The ratio of Mw/Mn of lower than 8 is practically undesirable because the anti-offset property becomes poor and other disadvantages are involved, even though the fixability tends to be improved as the ratio lowers.

In the molecular distribution curve of the THF-soluble portion, one molecular weight peak in the range of from $3.0\times10^3$ to $4.5\times10^4$ (MA), one molecular weight peak in the range of from $3.8\times10^5$ to $1.0\times10^6$ (MB) and a local minimum point in the region of from $2.0\times10^4$ to $3.8\times10^5$ (Md) are present, and the ratio of MA/MB being in the range of from 10 to 150. Preferably, peak molecular weight MA and MB exist in the molecular weight regions of from $5.0\times10^3$ to $3.0\times10^4$ and from $4.5\times10^5$ to $9.0\times10^5$ respectively, and the local minimum point in the range of from $5.5\times10^4$ to $2.5\times10^5$ the ratio MA/MB is in the range of from 15 to 120. Other preferably peak molecular weight MA and MB exist in the molecular weight regions of from $3.0\times10^3$ to $2.0\times10^4$ and from $3.8\times10^5$ to $1.0\times10^6$ respectively, and the local minimum point in the range of from $2.0\times10^4$ to $3.8\times10^5$, the ratio MA/MB is in the range from 30 to 150.

Further, other preferably peak molecular weight MA and MB exist in the molecular weight regions of from $1.5\times10^4$ to $4.0\times10^4$ and from $3.8\times10^5$ to $1.0\times10^6$, respectively, and the local minimum-point in the range of from $4.0\times10^4$ to $3.8\times10^5$ the ratio MA/MB is in the range of from 10 to 70.

When the peak molecular weight exists only in the region of from $3\times10^3$ to $4.5\times10^4$ the anti-blocking property and the anti-offset property are poor although the fixability is satisfactory. When the peak molecular weight exists only in the range of from $3.8\times10^5$ to $1.0\times10^6$, the fixability is poor although the anti-blocking property and the anti-offset property are satisfactory.

When the peak molecular weight MA is in the region of lower than $3.0\times10^3$, the anti-blocking property and the anti-offset property become poor, and further, the toner tends to melt-adhere to the developer-carrying member, the developer-applying blade, or the feeding roller. When the peak molecular weight MA is in the region of higher than $4.0\times10^4$, the fixability tends to be impaired. On the other hand, when the peak molecular weight MB is in the region of lower than $3.8\times10^5$, the anti-offset property is impaired, and further, a fusion is liable to occur in a toner grinding step of toner production, while, when the peak molecular weight MB is in the region of higher than $1.0\times10^6$, the fixability is tends to be impaired.

The ratio of the peak molecular weights, MA/MB, is in the range of from 10 to 150, preferably from 15 to 120, more preferably from 25 to 100. When the ratio MA/MB is less than 10 or more than 150, the fixability and the anti-offset property cannot simultaneously satisfied.

In the case where two or more peaks exist in the molecular weight region of from $3.0\times10^3$ to $4.5\times10^4$ the molecular weight corresponding to the one having the highest peak height in GPC chromatogram is taken as MA. Similarly, in the case where two or more peaks exist in the molecular weight range of from $3.8\times10^5$ to $1.0\times10^6$, the molecular weight corresponding to the one having the highest peak height in GPC chromatogram is taken as MB.

In the case where two or more local minimums exist in the molecular weight range of from $2.0\times10^4$ to $3.8\times10^5$, the molecular weight corresponding to the one having the lowest height in GPC chromatogram is taken as Md.

The area ratio, SA:SB:Sd, of the molecular weight distribution curve is 1:(0.2–0.7):(0.2–0.8), preferably 1:(0.25–0.55):(0.2–0.7), more preferably 1:(0.3–0.45):(0.3–0.7). When the area ratio of SB to SA is lower than 0.2, the anti-offset property is impaired, and fogging, black spots around the line image, and density-lowering are liable to arise owing to toner deterioration during running, while, when the area ratio of SB higher than 0.7, the fixability is impaired and the grindability is liable to be impaired. When the area ratio of Sd is lower than 0.2 or higher than 0.8, the fixability and the anti-offset property cannot be sufficiently consistent. It is preferred that the ratio of SA:SB:Sd is 1:(0.25–0.7):(0.3–0.8) when the THF-soluble portion of the binder resin has a molecular weight distribution curve pattern determined by GPC in which a ratio of weight average molecular weight/number-average molecular weight (Mw/Mn) is not less than 18, and at least one peak in the range of molecular weight of from $3.0\times10^3$ to $2.0\times10^4$ (MA), at least one peak in the range of molecular weight of from $3.8\times10^5$ to $1.0\times10^6$ (MB), and a local minimum point in the range of molecular weight of from $2.0\times10^4$ to $3.8\times10^5$ (Md) are present and peak molecular weight ratio MB/MA being from 30 to 150. It is further preferred that the ratio of SA:SB:Sd IS 1:(0.2–0.5):(0.2–0.5) when the THF-soluble portion of the binder resin has a molecular weight distribution curve pattern determined by GPC in which a ratio of weight average molecular weight/number-average molecular weight (Mw/Mn) is not less than 8 and at least one peak in the range of molecular weight of from $1.5\times10^4$ to $4.0\times10^4$ (MA), at least one peak in the range of molecular weight of from $3.9\times10^5$ to $1.0\times10^6$ (MB) and a local minimum point in the range of molecular weight of from $4.0\times10^4$ to $3.8\times10^5$ (Md) are present and peak molecular weight ratio MB/MA being from 10 to 70.

The binder resin employed in the toner of the present invention is produced by mixing a polymer A having a weight-average molecular weight of from $5.0\times10^3$ to $6.0\times10^4$ and a polymer B having a weight-average molecular weight of from $4.0\times10^5$ to $1.5\times10^6$ in a solvent followed by the solvent removal. Preferably the binder resin is produced by mixing a polymer A having a weight-average molecular weight of from $7.0\times10^3$ to $2.5\times10^4$ and a polymer B having a weight-average molecular weight of from $4.5\times10^5$ to $1.0\times10^6$ in a solvent and removing the solvent.

The binder resin is preferably produced by mixing a polymer A having a weight-average weight of from $5.0\times10^3$ to $3.0\times10^4$ and a polymer B having a weight-average molecular weight of from $4.0\times10^5$ to $1.5\times10^6$ in a solvent and removing the solvent, when the THF-soluble portion of the binder resin has a molecular weight distribution curve pattern determined by GPC in which a ratio of weight-average molecular weight-/number-average molecular weight (Mw/Mn) is not less than 18, and at least one peak in the range of molecular weight of from $3.0\times10^3$ to $2.0\times10^4$ (MA), at least one peak in the range of molecular weight of from $3.8\times10^5$ to $1.0\times10^6$ (MB), and a local minimum point in the range of molecular weight of from $2.0\times10^4$ to $3.8\times10^5$ (Md) are present and peak molecular weight ratio MB/MA being from 30 to 150 and the ratio of SA:SB:Sd is 1:(0.25–0.7):(0.3–0.8), and further the binder resin-is preferably produced by mixing a polymer A having a weight-average molecular weight of from $2.0\times10^4$ to $6.0\times10^4$ and a polymer B having a weight-average molecular weight of from $4.0\times10^5$ to $1.5\times10^6$ in a solvent and removing the solvent when the THF-soluble portion of the binder resin has a molecular weight distribution curve pattern determined by GPC in which a ratio of weight average molecular weight/average-number molecular weight (Mw/Mn) is not less than 8, and at least one peak in the range of molecular weight of from $1.5\times10^4$ to $4.0\times10^4$ (MA), at least one peak in the range of molecular weight of from $3.8\times10^5$ to $1.0\times10^6$ (MB) and a local minimum point in the range of molecular weight of from $4.0\times10^4$ to $3.8\times10^5$ (Md) are present and peak molecular weight ratio MB/MA being from 10 to 70 and the ratio of SA:SB:Sd is 1:(0.2–0.5):(0.2–0.5). Any solvent may be used which dissolves both of the polymer A and the polymer B, the example including toluene, xylene, and 2-propanone.

In the production of the binder resin for the toner of the present invention, the polymer A is preferably be prepared by solution polymerization or suspension polymerization, and the polymer B is preferably prepared by suspension polymerization or emulsion polymerization. More preferably the polymer A is prepared by solution polymerization and the polymer B is prepared by suspension polymerization.

In order to produce a binder resin having an uniform composition and molecular weight distribution, it is prefered to mix the polymer A and the polymer B in a solvent and then remove the solvent. Other mixing methods such as hot-melt kneading by a kneader cannot readily give a binder resin having a homogeneous composition and a uniform molecular weight distribution, and cannot readily satisfy the fixability, anti-offset property and developing property, causing undesirable melt-adhesion to a developer-carrying member, a developer-applying blade, a developer-feeding roller, or a photosensitive member.

The polymer A having a weight-average molecular weight of lower than $5.0\times10^3$ is not preferred because the anti-offset property becomes poor, and further the static chargeability becomes poor causing defects of image such as fogging. The polymer A having a weight-average molecular weight of higher than $6.0\times10^4$ is not preferred because the fixability becomes impaired.

The polymer B having a weight-average molecular weight of lower than $4.0\times10^5$ is not preferred because the anti-offset property becomes lower and the anti-blocking property is impaired in this region of the molecular weight. The polymer B having a weight-average molecular weight of higher than $1.5\times10^6$ is not preferred because the polymer exhibits an extremely high melt-viscosity in melt-kneading in toner preparation resulting in remarkably low grindability.

Single use of the polymer A or the polymer B as the binder resin of the toner will not accomplish the object of the present invention. Furthermore, melt-kneading of the polymer A with the polymer B will not achieve the object of the present invention, but mixing in a solvent and subsequent removal of the solvent will give favorable results. The use of the polymer B in preparation of the toner of the present invention makes it possible to satisfy the incompatible properties such as anti-offset property and fixability at a low temperature.

The polymer A is preferably a low-temperature softening styrene-acrylic type resin prepared by solution polymerization, and the polymer B is preferably a high-temperature fixable styrene-acrylic type resin prepared by suspension polymerization. The low-temperature softening resin has preferably a weight-average molecular weight (Mw) within the range of from $5.0\times10^3$ to $6.0\times10^4$, more preferably from $5.0\times10^3$ to $4.0\times10^4$, further more preferably from $7.0\times10^3$ to $2.5\times10^4$. The low-temperature softening resin having a weight-average molecular weight (Mw) of lower than $5.0\times10^3$ tends to cause poor anti-blocking property and lower storage stability, and further is liable to cause melt-adhering to the photosensitive member during developement of images giving bad effect on the images. The low-temperature softening resin having a weight-average molecular weight (Mw) of higher than $6.0\times10^4$ is liable to show less low-temperature fixability, tending to increase the power consumption in fixing the toner to a recording medium.

The ratio of weight-average molecular weight to number-average molecular weight (Mw/Mn) of the low-temperature softening resin is preferably not more than 3.5, more preferably not more than 3.0. By lowering the ratio Mw/Mn below 3.5, the low-temperature fixability is improved.

The flow-beginning temperature of the low-temperature softening resin as measured by Flow Tester is preferably not lower than 75° C., more preferably not lower than 80° C. The low-temperature softening resin having a flow-beginning temperature of lower than 75° C. by Flow Tester tends to impair the anti-blocking property of the toner, while the one having the flow-beginning temperature of higher than 90° C. by Flow Tester makes it difficult to achieve low-temperature fixability of toner in combination with a high-temperature softening resin.

The softening temperature of the low-temperature softening resin is preferably in the range. of from 80° to 110° C., more preferably from 85° to 105° C. The low-temperature softening resin having a softening temperature of lower than 80° C. gives rise to excessive melting tendency, even in combination with a high temperature softening resin, causing disadvantages such as gloss of image surface, permeation into transfer paper, pass-to-backside, and blotting of images owing to spreading of melted toner, while the one having a softening temperature of higher than 110° C. can hardly achieve low-temperature fixability, and increases power consumption for fixing the toner to a recording medium. Accordingly, satisfactory low-temperature fixability is achieved by use of the aforementioned polymer A, namely a low-temperature softening resin.

The low-temperature softening resin has preferably a glass transition temperature of not lower than 40° C., more preferably in the range of from 50° to 80° C., further more preferably from 55° to 70° C.

On the other hand, the inventors of the present invention investigated the offset phenomenon. As a result, they have found that the low temperature fixability is obtained by the low-temperature softening resin when the low-temperature softening resin is contained at a content of 50% by weight or more, preferably 55% by weight or more based on the entire binder resin. Therefore, for a resin to be added to improve the anti-offset property, it is required to prevent the offset at a low content.

It has become clear that the polymer B as the resin for improving the anti-offset property should be a high-temperature softening resin which is extremely different from the low-temperature softening resin in the molecular weight and the melt viscosity behavior. The high-temperature softening resin is preferably styrene-acrylic type resins which has a weight-average molecular weight (Mw) in the range of from $4.0\times10^5$ to $1.5\times10^6$ preferably from $4.5\times10^5$ to $1.0\times10^6$. When the high-temperature softening resin having a weight-average molecular weight (Mw) of lower than $4.0\times10^5$ is combined with the low-temperature softening resin at a ratio that the low-temperature fixing is possible, the offset phenomenon will arise. When the high-temperature softening resin having a weight-average molecular weight of higher than $1.5\times10^6$ is combined, the low-temperature fixability is impaired.

The high temperature-softening resin has a ratio of weight-average molecular weight to number-average molecular weight (Mw/Mn) of not more than 5.0, preferably not more than 4.5, more preferably not more than 3.5. At the ratio exceeding 5.0, the fixability tends to be lowered. The high-temperature softening resin has preferably a softening temperature of from 150° to 230° C., preferably from 160° to 210° C., and also preferably has a flow-beginning temperature by Flow Tester in the range of from 110° to 160° C., preferably from 115° to 150° C.

When the high-temperature softening resin having a flow-beginning temperature of lower than 110° C. by Flow Tester or a softening temperature of lower than 150° C. is used in combination with the low-temperature softening resin at a ratio at which the low-temperature fixing is achievable, the offset phenomenon tends to occur, and when the flow-beginning temperature is higher than 160° C. or the softening temperature is higher than 230° C. the low-temperature fixability tends to be impaired. The high-temperature softening resin has a softening point (Tg) preferably of not lower than 40° C., more preferably in the range of from 50° to 70° C. When the high-temperature softening resin has a softening point of lower than 40° C., the polymer molecule chain thereof is liable to be sheared during melt-kneading in toner production, and melt-adhering to the photosensitive member is liable to occur intoner development.

The ratio of the low-temperature softening resin to the high-temperature softening resin in the binder resin of the present invention is preferably in the range of from 50:50 to 90:10 by weight. When the ratio of the low-temperature softening resin is less than 50 parts by weight and the ratio of the high-temperature softening resin is more than 50 parts by weight to 100 parts by weight of the binder resin, the low-temperature fixability becomes poor. When the ratio of the low-temperature softening resin is more than 90 parts by weight and the ratio of the high-temperature softening resin is less than 10 parts by weight to 100 parts by weight of the binder resin, the offset phenomenon may occur and the picture image is liable to be adversely affected. Further, when the ratio of the high-temperature softening resin is more than 50 parts by weight, grindability in toner production tends to be lowered, lowering production efficiency.

Another characteristic of constitution of the toner of the present invention is that the low-temperature softening resin of the binder resin is preferably prepared by solution polymerization or suspension polymerization and the high-temperature softening resin is preferably prepared by suspension polymerization or emulsion polymerization, and the mixing of the two resins is conducted in a solvent which is capable of dissolving both resins.

The high-temperature softening resin having the molecular weight distribution and the melt-viscosity behavior is preferably prepared by suspension polymerization. The low-temperature softening resin is preferably prepared by solution polymerization in view of the mixing in a solution with the high-temperature softening resin after the polymerization.

The mixing of the low-temperature softening resin with the high-temperature softening resin is practiced by solution mixing. Other mixing methods cannot readily give homogeneous mixing, and tend to affect adversely the toner characteristics.

In the solution mixing, any remaining monomer can be removed by a solvent removal process.

The non-magnetic toner for the non-magnetic one-component type developer contains a releasing agent having specified properties. The releasing agent has a number-average molecular weight (Mn) of not higher than $3.0\times10^3$, preferably not higher than $1.0\times10^3$ a weight-average molecular weight (Mw) of not higher than $1.2\times10^4$, preferably not higher than $7.5\times10^3$, more preferably not higher than $2.5\times10^3$, the ratio of weight-average molecular weight to number-average molecular weight (Mw/Mn) of not higher than 4, and a melting point in the range of from 60° to 150° C., preferably from 60° to 140° C. Preferably the releasing agent has a number-average molecular weight (Mn) of not higher than $2.5\times10^3$, a weight-average molecular weight (Mw) of not higher than $7.0\times10^3$, the ratio of weight-average molecular weight to number-average molecular weight (Mw/Mn) of not higher than 3.0, and a melting point in the range of from 60° to 120° C.

The releasing agent is contained at a content of from 0.1 to 20% by weight, preferably from 1 to 10% by weight based on the binder resin in the non-magnetic toner.

If the releasing agent in the present invention does not satisfy the above-mentioned conditions, the desired results cannot be obtained. For example when the number-average molecular weight (Mn) exceeds $3.0\times10^3$, or the weight-average molecular weight exceeds $1.2\times10^4$, satisfactory fixability cannot be achieved. When the melting point exceeds 150° C., sufficient fixability cannot be achieved, while with the melting point of lower than 60° C. the anti-offset property and anti-blocking property is insufficient. When the content of the releasing agent in the non-magnetic toner exceeds 20% by weight, the anti-blocking property of the toner deteriorates when stored at a high temperature, while with the content lower than 0.1% by weight the anti-offset-property of the toner is insufficient.

The toner of the present invention has a flow-beginning temperature in the range of from 90° to 140° C., preferably from 100° to 125° C., a softening point in the range of from 110° to 160° C., preferably 130° to 150° C., and a glass transition temperature (Tg) in the range of from 50° to 70° C., preferably from 55° to 70° C.

The resin composition employed for the binder resin of the toner in the present invention is preferably those prepared by polymerizing one or more monomers selected from styrene type monomers and acrylic monomers such as acrylic acids, methacrylic acids, and their derivatives in view of the development characteristics and static charging characteristics.

The styrene type monomers include styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, and 3,4-dichlorostyrene. Among them, styrene is the most preferable.

The acrylic monomers such as acrylic acids, methacrylic acids, and their derivatives mentioned above include acrylic acid, and acrylate esters including methyl acrylate, ethyl acrylate, n-butyl acrylate, isobutyl acrylate, propyl acrylate, n-octyl acrylate, dodecyl acrylate, lauryl acrylate, 2-ethylhexyl acrylate, stearyl acrylate, 2-chloroethyl acrylate, phenyl acrylate, and methyl α-chloroacrylate; methacrylic acid and methacrylate esters including methyl methacrylate, ethyl methacrylate, propyl methacrylate, n-butyl methacrylate, isobutylmethacrylate, n-octyl methacrylate, dodecyl methacrylate, lauryl methacrylate, 2-ethylhexyl methacrylate, stearyl methacrylate, phenyl methacrylate, dimethylaminoethyl methacrylate, and diethylaminoethyl methacrylate, and other esters of α-methylene aliphatic monocarboxylic acid; and derivatives of acrylic acid or methacrylic acid including acrylonitrile, methacrylonitrile, and acrylamide.

As the binder resin in the present invention, particularly preferred are copolymers of a styrene type monomer with an acrylic monomer.

In addition to the aforementioned monomers, one or more other monomers may be employed within the range in which the object of the present invention is achievable. Such monomers include, for example, 2-vinylpyridine, 4-vinylpyridine, vinylcarbazole, vinyl methyl ether, butadiene, isoprene, maleic anhydride, maleic acid, monoesters of maleic acid, diesters of maleic acid, and vinyl acetate.

The above monomers are polymerized in the presence or absence of an initiator, and a crosslinking agent.

The initiator includes di-t-butyl peroxide, benzoyl peroxide, lauroyl peroxide, t-butyl peroxylaurate, 2,2'-azobisisobutyronitrile, 1,1-bis(t-butylperoxy)3,3,5-trimethylcyclohexane, 1,1-bis(t-butylperoxy)cyclohexane, 1,4-bis(t-butylperoxycarbonyl)cyclohexane, 2,2-bis(t-butylperoxy)octane, n-butyl-4,4-bis(t-butylperoxy)valerate, 2,2-bis(t-butylperoxy)butane, 1,3-bis(t-butylperoxy-isopropyl)benzene, 2,5-dimethyl-2,5-di(t-butylperoxy)hexane, 2,5-dimethyl-2,5-di(t-butylperoxy)hexane-3, 2,5-dimethyl-2,5-di(benzoylperoxy)hexane, di-t-butyl peroxyisophthalate, 2,2-bis(4,4-di-t-butylperoxycyclohexyl)propane, di-t-butylperoxy-α-methylsuccinate, di-t-butylperoxydimethyl glutarate, di-t-butylperoxy hexahydroterephthalate, di-t-butylperoxy azelate, 2,5-dimethyl-2,5-di-(t-butylperoxy)hexane, diethylglycol-bis(t-butyl peroxycarbonate), di-t-butylperoxy trimethyladipate, triazine, tris(t-butylperoxy)triazine, vinyltri(t-butylperoxy)silane, cumin perpivalate, dicumyl peroxide, azoisobutyronitrile, and dimethylazoisobutyrate.

The above polymerization initiators are used singly or in combination in consideration of the amount used, the polymerization temperature, and the half-life.

The crosslinking agent employed for the toner in the present invention includes two-functional crosslinking agents such as divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentylglycol diacrylate, diethylene glycol diacrylate, triethylene glycol diacrylate, tetraethylene glycol diacrylate, diacrylates of polyethylene glycols #200, #400, and #600, dipropylene glycol diacrylate, polypropylene glycol diacrylate, and polyester type diacrylates (MANDA, made by Nippon Kayaku Co.); and methacrylates of the above compounds in place of acrylate.

Further the crosslinking agent for the toner includes polyfunctional crosslinking agents such as pentaerythritol triacrylate, trimethylolethane triacrylate, trimethylolpropane triacrylate, tetramethylolpropane tetracrylate, oligoester acrylate, and methacrylates of the above compounds in place of acrylates, 2,2-bis-(4-methacryloxypolyethoxyphenyl)propane, diallyl phthalate, triallyl cyanurate, triallyl cyanurate, triallyl isocyanurate, triallyl trimellitate, and diallyl chlorendate.

Such a crosslinking agent is preferably not added in the binder resin to make the THF-insoluble matter content less than 10% by weight. When it is added, its content is less than 1% by weight, preferably not more than 0.5% by eight, more preferably not more than 0.2% by weight based on the binder resin.

The toner employed in the present invention preferably contains at least one releasing agent of which a number-average molecular weight (Mn) is not higher than $3.0\times10^3$, a weight-average molecular weight is not higher than $1.2\times10^4$, the ratio Mw/Mn is not more than 4.0, and a melting point is in the range of from 60° to 150° C. as mentioned above. The amount of the releasing agent to be added is preferably in the range of from 0.1 to 20% by weight, more preferably from 1 to 10% by weight based on the binder resin.

The releasing agent suitably used to the toner in the present invention includes paraffin wax, low-molecular-weight polyethylene wax, low-molecular-weight ethylene-propylene copolymer, low-molecular weight polypropylene wax, and polyolefin wax modified by graft polymerization of an aromatic vinyl monomer such as styrene and derivatives of styrene, or unsaturated aliphatic acids or an unsaturated aliphatic acid ester. Among these releasing agents, polyolefin wax modified by graft polymerization is particularly preferred in view of elongated life of a developing agent and machines such as a copying machine employing the developing agent, and in view of service maintenance thereof.

The unsaturated aliphatic acid or the ester thereof used for synthesis of the graft-modified polyolefin includes methacrylic acid; methacrylates such as methyl methacrylate, ethyl methacrylate, propyl methacrylate, n-butyl methacrylate, isobutyl methacrylate, n-octyl methacrylate, 2-ethylhexyl methacrylate, lauryl methacrylate, stearyl methacrylate, dodecyl methacrylate, phenyl methacrylate, dimethylaminoethyl methacrylate, diethylaminoethyl methacrylate, 2-hydroxyethyl methacrylate, 2,2,2-trifluoroethyl methacrylate, and glycidyl methacrylate; acrylic acid; acrylates such as methyl acrylate, ethyl acrylate, propyl acrylate, n-butyl acrylate, isobutyl acrylate, n-octyl acrylate, lauryl acrylate, stearyl acrylate, dodecyl acrylate, 2-ethylhexyl acrylate, phenyl acrylate, 2-chloroethyl acrylate, 2-hydroxyethyl acrylate, cyclohexyl acrylate, dimethylaminoethyl acrylate, diethylaminoethyl acrylate, dibutylaminoethyl acrylate, 2-ethoxy acrylate, and 1,4-butenediol diacrylate; unsaturated dibasic acids and their esters such as maleic acid, fumaric acid, itaconic acid, citraconic acid, monoethyl maleate, diethyl maleate, monopropyl maleate, dipropyl maleate, monobutyl maleate, dibutyl maleate, di-2-ethylhexyl maleate, monoethyl fumarate, diethyl fumarate, dibutyl fumarate, di-2-ethylhexyl fumarate, monoethyl itaconate, diethyl itaconate, monoethyl citraconate, and diethyl citraconate. These monomers may be used individually or in combination of two or more thereof.

The aromatic vinyl monomer includes styrene, o-methylstyrene, m-methylstyrene, p-ethylstyrene, α-methylstyrene, 2,4-dimethylstyrene, p-methylstyrene, p-n-butylstyrene, p-tert-butylstyrene, p-n-dodecylstyrene, p-phenylstyrene, and p-chlorostyrene. These monomers may be used individually or in combination of two or more thereof.

The graft-modification may be conducted by a known conventional method. For example, the above polyolefin and the aromatic vinyl monomer and the unsaturated aliphatic acid or ester thereof are mixed in a molten state or dissolved in a solvent, and reacted by heating in the presence or absence of a radical initiator under atmospheric or increased pressure to obtain a graft-modified polyolefin. The grafting by the aromatic vinyl monomer and the grafting by the unsaturated aliphatic acid or the ester thereof may be practiced either separately or simultaneously.

The initiator employed for the grafting reaction includes benzoyl peroxide, dichlorobenzoyl peroxide, di-tert-butyl peroxide, lauroyl peroxide, tert-butyl perphenylacetate, cumin perpivalate, azobisisobutyronitrile, dimethylazoisobutylate, and dicumyl peroxide.

The toner in the present invention may contain one or more releasing agent having a melting point above 150° C. within an amount which does not affect adversely the fixability of the toner.

The toner in the present invention may contain a chargeability-controlling agent. Known positive or negative chargeability-controlling agent may be used therefor. The examples are shown below:

(1) The chargeability-controlling agent which controls the toner to be positively chargeable includes the substances below:

(a) nigrosine; azine dyes having an alkyl of 2–16 carbons (Japanese Patent Publication No. 42-1627), basic dyes such as C.I. Basic Yellow 2 (C.I.41000), C.I. Basic Yellow 3, C.I. Basic Red 1 (C.I. 45160), C.I. Basic Red 9 (C.I. 42500), C.I. Basic Violet 1 (C.I.42535), C.I. Basic Violet 3 (C.I. 42555), C.I. Basic Violet 10 (C.I. 45170), C.I. Basic Violet 14 (C.I. 42510), C.I. Basic Blue 1 ( C. I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44025), C.I. Basic Green 1 (C.I. 42040), C.I. Basic Green 4 (C.I. 42000); lake pigments of the above basic dyes (the laking agent including phosphotungstic acid, phosphomolybdic acid, phosphotungstenmolybdate, tannic acid, lauric acid, gallic acid, and ferricyanates, ferrocyanates), C.I. Solvent Black 3 (C.I 26150), Hanza Yellow G (C.I. 11680), C.I. Mordant Black 11, and C.I. Pigment Black 1.

(b) Benzylmethylhexadecylammonium chloride, decyltrimethylammonium chloride, dialkyl tin compound such as of dibutyltin and dioctyltin, metal salts of higher fatty acids, fine powder of inorganic substance such as mica and zinc oxide, metal complexes of EDTA and acetylacetone, amino-group-containing vinyl type polymers, and polyamine resins such as amino-group-containing condensation polymers, (c) Quaternary ammonium salts represented by the general formula below, having a cation component at a molecular weight ratio of 55%, wherein R1 to R4 represent respectively an alkyl group, an aryl group on a derivative thereof:

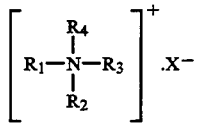

an example being shown below:

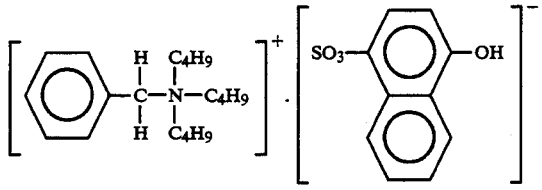

Among the control substances which make the toner positively chargeable, nigrosine and quaternary ammonium salts are particularly preferred in view of chargeability and dispersibility.

(2) The chargeability-controlling agent which makes the toner negatively chargeable includes the substances below:

Metal-containing compounds of monoazo dyes described in Japanese Patent Publication Nos. 41-20153, 42-27596, 44-6397, and 45-26748; nitrofumaric acid and its salts described in Japanese Laid-Open Patent Application No.50-133338; pigments like C.I. 14645; metal compounds of salicylic acid, naphthoic acid, and dicarboxylic acids with Zn, Al, Co, Or, or Fe described in Japanese Patent Publication Nos. 55-42752, 58-41508, 58-7384, and 59-7384; sulfonated copper phthalocyanine pigments; styrene oligomers having a nitrile group or a halogen; and chlorinated paraffin.

Among the above substances which control the toner to be negatively chargeable, preferred are metal-containing compounds of monoazo dyes; and metal-containing compounds of salicylic acid, alkylsalicylic acid, naphthoic acid, and dicarboxylic acid.

To the toner of the present invention, an additive or additives may be added, if necessary. The additive includes lubricants such as Teflon, zinc stearate, and polyvinylidene fluoride, (polyvinylidene fluoride being preferable); abrasive materials such as cerium oxide, silicon carbide, strontium titanate (strontium titanate being preferable); fluidity-donating agents such as colloidal silica, aluminum oxide, and titanium oxide (hydrophobic colloidal silica being preferable); caking inhibitor; electric-conductivity-donating agents such as carbon black, zinc oxide, antimony oxide, and tin oxide; fixing aids such as waxes like low-molecular-weight polyethylene, low-molecular-weight polypropylene, and other waxes; and anti-offset agents. Further, white fine powder or black fine powder having polarity opposite to the charging polarity of the toner may be used as a developability-improving agent.

Any suitable pigment or dye may be used as the coloring agent for the toner of the present invention. Known toner coloring matters include pigments such as carbon black, aniline black, acetylene black, naphthol yellow, hanza yellow, rhodamine lake, alizarin lake, red iron oxide, phthalocyanine blue, and indanthrene blue. Such a pigment is used in an amount sufficient to keep the optical density of the fixed image in the range of from 0.1 to 20 parts, preferably from 2 to 10 parts by weight to 100 parts by weight of the resin. Known toner coloring matters also include dyes such as azo dyes, anthraquinone dyes, xanthene dyes, and methine dyes. Such a dye is used in an amount of from 0.1 to 20 parts by weight, preferably 0.3 to 3 parts by weight to 100 parts by weight of the resin.

A toner of the present invention is produced as follows. The resin composition of the present invention, a chargeability-controlling agent, a pigment or a dye as a coloring matter, an additive, and the like are premixed sufficiently by means of a mixer like a ball mill. The mixture is then melt-kneaded by means of a heat-blender such as a heating roll, a kneader, and an extruder to dissolve or disperse the pigment or the dye in the mutually dissolved resin, and cooled, solidified, powdered, and classified to obtain a toner having an average particle diameter of from 3 to 20 μm.

The THF-insoluble matter in the present invention means a THF-insoluble component (a giant molecule or crosslinked polymer) in the resin or the toner, expressed in weight %. The THF-insoluble matter is measured as below.

A resin sample or a toner sample is weighed in an amount of from 0.5 to 1.0 g ($W_1$ g). The weighed sample is placed in an extraction thimble (e.g., No.86R, made by Toyo Roshi K.K.), and is extracted with 100 to 200 ml of THF as the solvent for 6 hours by means of Soxhlet extractor. The THF extract is evaporated and dried in vacuo at 100° C. for several hours. The THF-soluble resin portion is weighed ($W_2$ g). In measurement of the THF-insoluble matter of a toner, the insoluble matter such as a pigment other than the resin is weighed ($W_3$ g). In measurement of the THF-insoluble matter of the resin, $W_3$ is made 0 g. The THF-insoluble matter is derived from the formula below.

THF-insoluble matter (%)=

$$[W_1-(W_3+W_2)/(W_1-W_3)]\times 100$$

($w_3=0$ in the measurement of the resin)

The molecular weights corresponding to the peak and the shoulder of the chromatogram in GPC (gel permeation chromatography) in the present invention are measured under the following conditions.

The column is stabilized in a heat chamber kept at 40° C. At this column temperature, THF is made to flow as the solvent at a rate of 1 ml per minute. Thereto, 50–200 μl of a THF solution of a resin (0.05 to 0.6% by weight) is injected. The molecular weight distribution of the polymer is calculated from the calibration curve showing the relation of the count number and the molecular weight, which was prepared using several standard samples of monodisperse polystyrene. Suitably at least about 10 standard polystyrene samples are used to prepare the calibration curve, the standard polystyrene having the molecular weight: $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$. These standard polystyrene samples are made for example, by Pressure Chemical Co. and Toyo Soda Manufacturing Co. The detector is an RI detector (a refractive index detector).

As columns, several commercial polystyrene gel columns are used in combination in order to conduct precise measurement of molecular weight region from $10^3$ to $2\times10^6$. Preferable column combinations are: μ-Styragel 500, $10^3$, $10^4$ and $10^5$ made by Waters Co; Shodex KF-80M, or KF802, 803, 804, and 805 made by Showa Denko K.K.; and TSK gel G1000H, G2000H, G2500H, G3000H, G4000H, G5000H, G6000H, G7000H, and GMH.

The values of SA, SB, and Sd of the molecular weight distribution curve of the binder resin for the toner of the present invention is obtained from the area ratio by cutting and weighing the GPC chromatogram as shown in FIG. 1, calculating the ratio, and substracting the weight percentage of the THF-insoluble matter.

The molecular weight distribution of the binder resin is measured by GPC (gel permeation chromatography) in the present invention under the conditions below.

GPC measurement condition:

Apparatus: GPC-150 (made by Waters Co.)

Column: Shodex KF-801, KF-802, KF-803, KF-804, KF-805, KF-806, KF-807, and KF-800P (8-column series) (made by Showa Denko K.K.)

Temperature: 40° C.

Solvent: Tetrahydrofuran (THF)

Flow rate: 1.0 ml/min

Sample: 0.5 to 5 mg/ml, Injection of 0.1 ml

The molecular weight of the sample is calculated from a molecular weight calibration curve prepared with monodisperse polystyrene standard samples.

The molecular weight distribution of the releasing agent is measured by GPC in the present invention under the conditions below.

GPC measurement condition:

Apparatus: GPC-150 (made by Waters Co.)

Column: Shodex KF-80M (2-column series) (made by Showa Denko K.K.)

Temperature: 135° C.

Solvent: o-Dichlorobenzene (containing 0.1% Ionol)

Flow rate: 1.0 ml/min

Sample: Injection of 0.4 ml of sample of 0.15%

The molecular weight of the sample is calculated from a molecular weight calibration curve prepared with monodisperse polystyrene standard sample.

Figure 3:
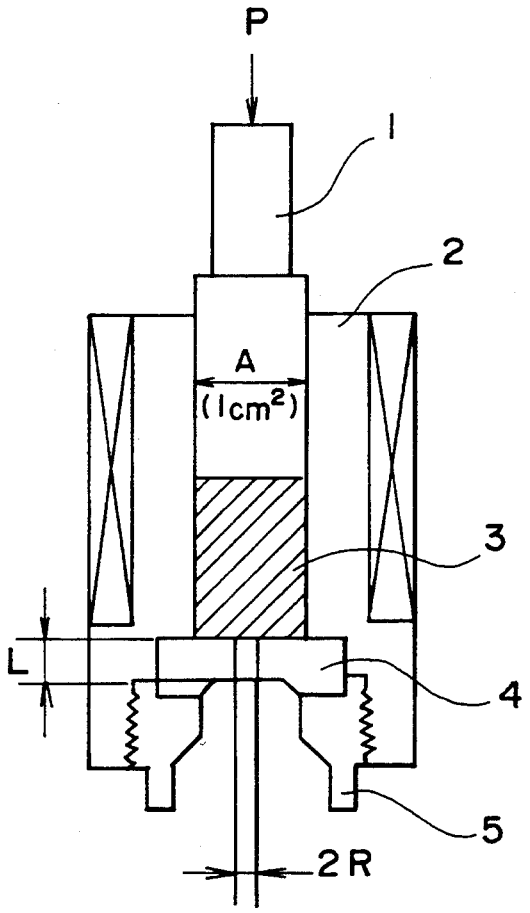
FIG. 3 is a schematic drawing of the main portion of the Koka-type flow tester.

The melt behavior of the binder resin is measured by means of a Koka Flow Tester (Model: CFT-500, made by Shimadzu Corporation) as shown in FIG. 3. 1.0 g of a sample 3 molded by a press molding machine is pressed with a plunger 1 at a load of 20 kgf at a temperature elevation rate of 5.0° C./min so as to extrude the sample through the nozzle 4 of 1 mm in diameter and 1 mm in length. The descending distance of the plunger of the Flow Tester is measured.

Figure 4:
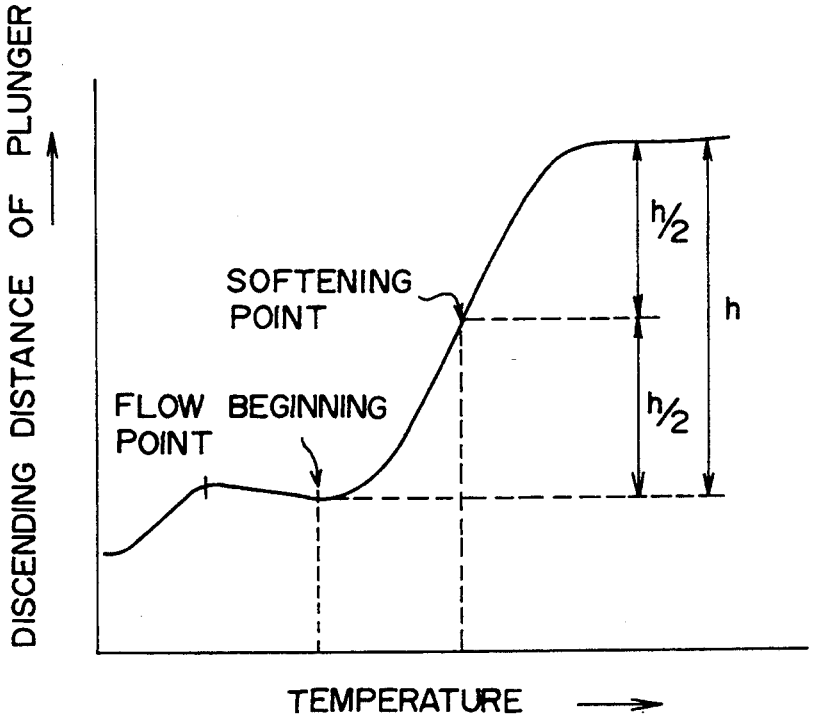
FIG. 4 illustrates the relationship between the downward movement of a plunger and temperature.

As shown in FIG. 4, taking the height of the sigmoid curve as "h" in the relation of the plunger descending distance with temperature, the temperature corresponding to the height "h/2" is defined to be the softening temperature, and the temperature at which the sample begins to flow out is defined to be a flow-beginning temperature.

Figure 2:
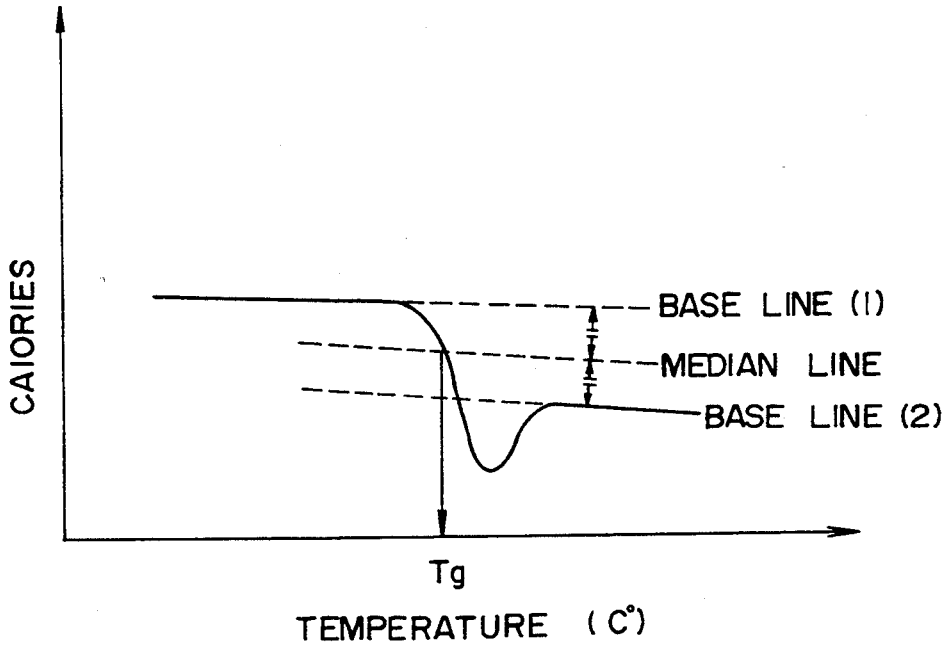
FIG. 2 shows a DSC curve for measuring a glass transition temperature (Tg).

The glass transition temperatures (Tg) of the binder resin and the toner in the present invention is measured by means of a differential scanning calorimeter DSC-7 (made by Perkin Elmer Co.) at a heating rate of 10° C./min according to a programmed temperature rising pattern of ASTM (D-3418-82). In the DSC curve of the second temperature elevation as shown in FIG. 2, "Tg" is defined as the temperature corresponding to the intersecting point of the rising curve and the median (middle) line between the base line (1) before the endothermic peak and the base line (2) after the endothermic peak.

The melting point of the releasing agent in the present invention is measured by means of a differential scanning calorimeter DSC-7 (made by Perkin Elmer Co.) at a heating rate of 10° C./min according to a programmed temperature rising pattern of ASTM (D-3418-82). The melting point is the temperature corresponding to the peak top showing the maximum of the melting temperature.

Figure 5:
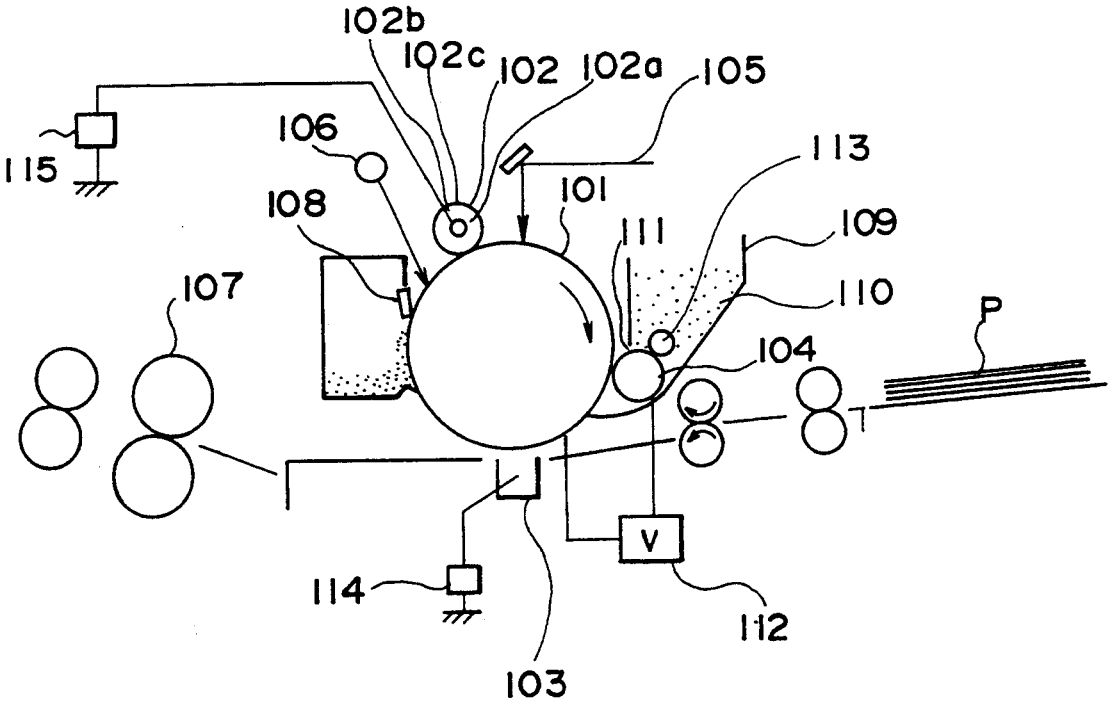
FIG. 5 schematically illustrates a process of image formation with a non-magnetic one-component type developer of the present invention.
Figure 6:
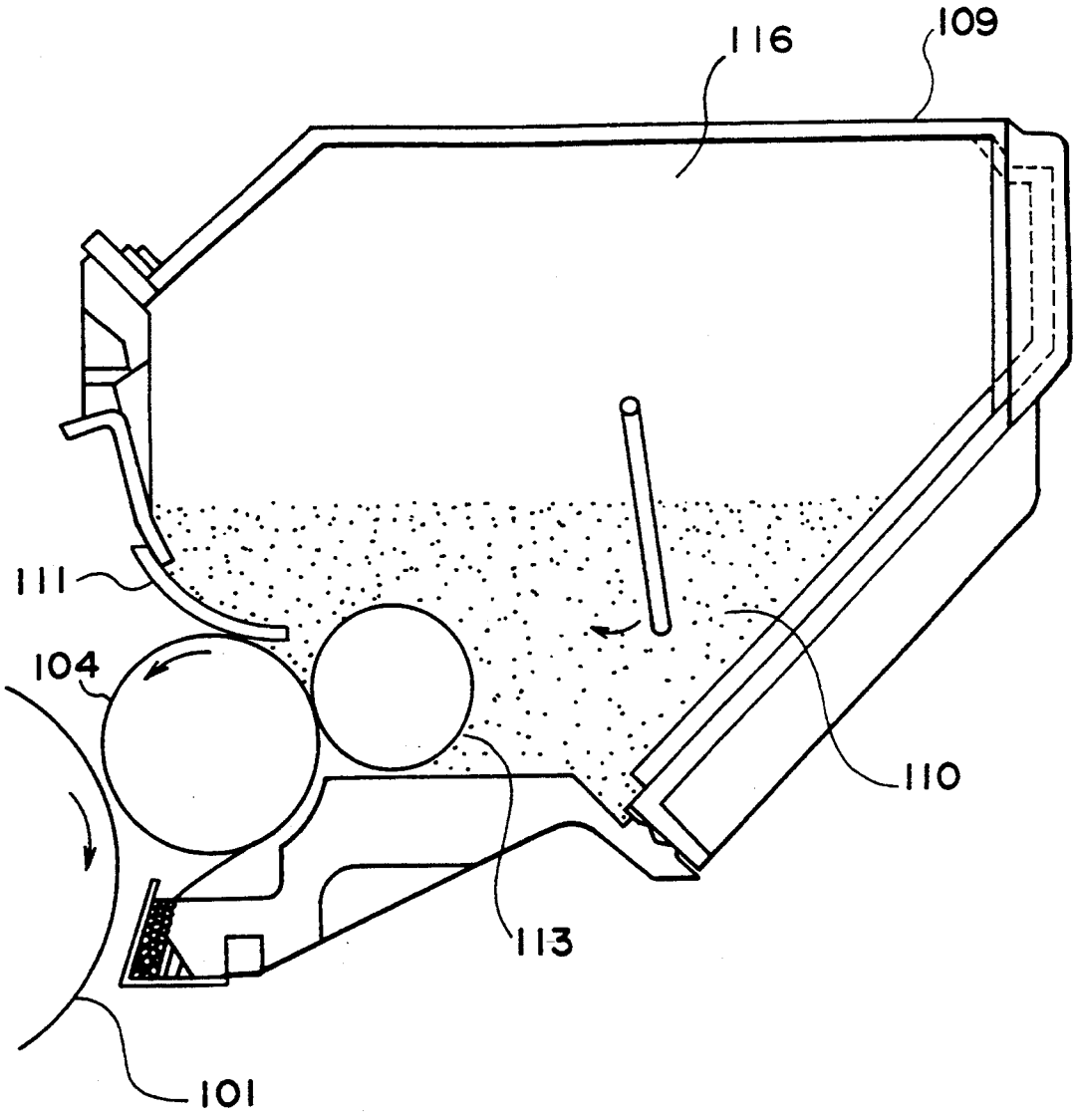
FIG. 6 is an enlarged partial view of FIG. 5 to explain the developing step.

The image-forming process and the image-forming apparatus of the present invention is explained, taking as an example an image-forming process in which a negatively charged image is developed with a positively chargeable developer, by reference to FIG. 5 and FIG. 6.

A charging roller 102 is brought into contact with a latent image holding member 101 at a predetermined pressure. The charging roller 101 has a metal shaft **102*a*, an electroconductive rubber layer 102*b* formed around the shaft, and a surface layer 102*c* as a releasing film formed on the peripheral surface of the rubber layer. The electroconductive rubber layer 102*b* has preferably a thickness in the range of from 0.5 to 10 mm, more preferably from 1 to 5 mm. The surface layer 102*c* is a releasing film which serves to prevent exudation of a softening agent from the electroconductive rubber layer 102*b* to a contacting portion of the image holding member 101**, suppressing image smudging caused by adhesion of the softening agent onto the photosensitive member to lower the resistance, the decrease of chargeability caused by filming of a remaining toner on the photosensitive member, and drop of charging efficiency.

Further, the use of the electroconductive rubber layer for the charging roller enables the sufficient contact between the charging roller and the photosensitive member without charging deficiency.

The releasing film has preferably a thickness of not more than 30 μm, more preferably from 10 to 30 μm. The minimum thickness of the releasing film is considered to be about 5 μm to prevent exfoliation or peeling of the film. The releasing film may be made of any of nylon type resin, PVDF resins (polyvinylidene fluoride), and, PVDC resins (polyvinylidene chloride).

For the photosensitive layer of the latent image holding member 101, OPC, amorphous silicon, selenium, ZnO may be used. Particularly when amorphous silicon is used as the photosensitive material, any adhesion of the softening agent exudated from the electroconductive rubber layer **10*b* to the latent image holding member 101**, however little it is, causes serious image smudging. Therefore, the insulating film exterior of the electroconductive rubber layer is remarkably effective in such a case.

For the purpose of preventing leakage to the photosensitive member, a high resistance layer such as a hydrin rubber layer which is hardly affected by environmental changes may be formed between the electroconductive layer and the releasing surface coating layer, which is an example of the preferred embodiment.

An electric power source 115 applies voltage to the charging roller 102, and applies a predetermined voltage to the metal shaft **102*a* of the charging roller 102**.

An image transferring means comprises a transferring charger 103, to which a predetermined bias voltage is applied by a constant-voltage power source. The bias conditions includes preferably a current of 0.1 to 50 μA and a voltage (absolute value) of 500 to 4000 V.

The charging roller as the charging means having a power source (a voltage applying means) 115 electrifies the surface of the photosensitive OPC surface of the latent image holding member 101, for example to give negative charge, and the electrostatic latent image is formed by light image exposure.

The developing means for developing an electrostatic latent image has a constitution as below. The developer-carrying member 104 is constituted of a non-magnetic sleeve made of aluminum or stainless steel. The developer-carrying member may be a untreated cylinder of aluminum or stainless steel, but preferably the surface thereof is treated, for example, toughened uniformly by blowing glass beads; planished; or coated with a resin. A developer 110 is stored in a hopper 116 of the developing means 109, and is fed onto the developer-carrying member by a feeding roller 113. The feeding roller 113 is made of a polyurethane rubber, and is pressed against the developer-carrying member 104, and rotates in a normal or a reverse direction at a speed of not zero relative to the developer-carrying member 104 to feed the developer and to remove the developer after development (unconsumed developer). The developer 110 fed onto the developer-carrying member 104 is smoothed by a developer applying blade 111 uniformly in a thin layer of 30 to 300 μm thick, and is charged by friction electrification. Subsequently, this developer 110 is brought extremely close, from 50 to 500 μm, to the latent image holding member 101 to develop a latent image formed on the latent image holding member 101. The contact pressure of the developer applying blade 111 against the developer-carrying member 104 is effectively in the range of from 3 to 250 g/cm, preferably from 10 to 120 g/cm in terms of a linear pressure in a sleeve-generating line direction. The contact pressure lower than 3 g/cm makes the uniform developer application difficult, causing broad distribution of the charge quantity, leading to fogging and black spots around the line image. The contact pressure higher than 250 g/cm gives unnecessarily high pressure to the developer, and deteriorates an external additive, tending undesirably to cause coagulation of the developer. The higher pressure is not preferred also because a larger torque is required to drive the developer-carrying member 104. The developer-applying blade is preferably made of a material selected from the frictional electrification series suitable for charging the developer to a desired polarity. For example, the frictional electrification efficiency is raised when silicone rubber, polyurethane, fluororubber, or polychloroprene rubber is used as the blade material in order to give positive charge to the developer and when styrene-butadiene rubber or nylon is used therefor in order to give negative charge to the developer. The frictional electrification ability of the blade to give charge to the developer can be adjusted by blending silica, fine particular resin, or the like. Further, excessive electrification of the developer can be prevented by giving appropriate electric conductivity to the blade by blending carbon, titanium oxide, or the like.

Using the above mentioned developing means, the electrostatic latent image on the latent image holding member is developed. In the developing section, alternate bias, pulse bias, and/or direct-current bias is applied between the latent image holding member 101 and the developing sleeve 104 by a bias-applying means 112. When a sheet of a transfer paper P has been introduced to the transfer section, the transfer paper P is electrified from the back face thereof by a voltage applying means 114 to electrostatically transfer the developed image (the toner image) on the latent image holding member 101 to the transfer paper P. The transfer paper P separated from the latent image holding member 101 is treated by heat-press roller 107 as the fixing means for fixing the toner image on the transfer paper P.

After the transfer process, the developing agent 110 remaining unconsumed on the latent image holding member 101 is removed by a cleaning member 108 having a cleaning blade. After the cleaning, the latent image holding member is destaticized by erasing exposure 106, and the cycle is repeated starting with the charging step with the charging roller 102.

In the developing section, the alternate current bias or a pulse bias may be applied between the developing sleeve 104 and the surface of the latent image holding member 101 from a bias power source 112 as the bias means. The bias conditions are preferably Vpp=1000 to 1800 V, and F=1000 to 2000 (Hz) as the alternate current bias, and DC=−200 to −400 V.

At the developing section formed at and around the site where the developing sleeve (a toner-carrying member) 104 and the latent image holding member 101 is brought closest, the developer 110 transfers to the latent image holding member 101, while the developer 110 reciprocates between the developing sleeve 104 and the latent image holding member 101 by the action of the electrostatic force of the charged face of the latent image holding member 101 and the action of the alternate bias or the pulse bias. As the photosensitive layer of the latent image holding member 101, the OPC photosensitive drum may be replaced suitably an insulating drum for electrostatic recording or by a photosensitive drum having a layer of a photosensitive insulating substance such as α-Se, CdS, $ZnO_2$, and α-Si.

The image forming process, the image forming apparatus, the apparatus unit, and the facsimile apparatus of the present invention employ a non-magnetic one-component type developer which contains at least a binder resin and a releasing agent. The binder resin comprises a THF-soluble portion and a THF-insoluble portion the latter being less than 10% by weight based on the binder, and the THF-soluble portion has a specified molecular-weight distribution determined by GPC. The releasing agent has the specified properties, and is contained in the specified amount in the toner. The non-magnetic one-component type developer is fed onto a developer-carrying member by a feeding roller, applied in a predetermined thickness onto the developer-carrying member by pressure of a developer-applying blade, and is charged by friction to form an image. Therefore, the image forming process, the image forming apparatus, the apparatus unit, and the facsimile apparatus of the present invention gives superior images constantly with no or little offset phenomenon in a broad temperature range from low to high temperature and with no or little image deterioration such as fogging and decrease of image density.

The present invention is described specifically by reference to examples without limiting the invention in any way. The "parts" in the examples is, based on weight.

Polymer Synthesis Example 1

In a reactor, 200 parts of xylene was placed, and was heated up to the reflux temperature. Thereto a mixture of 82 parts of styrene, 18 parts of butyl acrylate and 5.5 parts of di-tert-butyl peroxide was added dropwise at 130° C. in 3 hours. The solution polymerization was completed under refluxing of xylene. Then xylene was removed. The resulting styrene-butyl acrylate copolymer had a weight-average molecular weight (Mw) of 13,000 and a molecular-weight peak (MA) of 11,000 as shown in Table 1. This polymer is referred to as the Polymer A-1 for the binder resin of the present invention.

Polymer Synthesis Examples 2–5

The Polymers A-2 to A-5 for the binder resins of, the present invention were prepared by solution polymerization in the same manner as in Polymer Synthesis Example 1, except that the monomer composition, the polymerization initiator, and the solvent shown in Table 1 were used.

Polymer Synthesis Example 6

In a reactor, 200 parts of degassed water containing 0.2 parts of polyvinyl alcohol dissolved therein was placed, and thereto 80 parts of styrene, 20 parts of butyl acrylate, and 0.15 part of benzoyl peroxide were added to prepare a liquid suspension. The liquid suspension was heated and kept at 80° C. in a nitrogen atmosphere for 24 hours to complete the polymerization reaction. The reaction mixture was cooled to room temperature. The polymer was collected by filtration, washed sufficiently with water, dehydrated, and dried. The resulting styrene-butyl acrylate copolymer had a weight-average molecular weight (Mw) of 915,000 and a molecular-weight peak (MB) of 723,000 as shown in Table 2. This polymer is referred to as the polymer B-1 of the present invention.

Polymer Synthesis Examples 7–10

The binder resins B-2 to B-5 were prepared by suspension polymerization in the same manner as in Polymer Synthesis Example 1, except that the monomer composition, and the polymerization initiator shown in Table 2 were used.

Comparative Polymer Synthesis Example 1

A styrene-butyl acrylate copolymer was prepared from 95 parts of styrene, 5 parts of butyl acrylate, and 10 parts of di-tert-butyl peroxide by solution polymerization in the same manner as in Polymer Synthesis Example 1. The resulting copolymer had a weight-average molecular weight (Mw) of 3,600 and a peak molecular weight (MA) of 3,350 as shown in Table 3. This polymer is referred to as the Comparative Polymer A-1 for the comparative binder resin.

Comparative Polymer Synthesis Example 2

A styrene-butyl acrylate copolymer was prepared from 82 parts of styrene, 18 parts butyl acrylate, 0.2 part of divinylbenzene, and 0.8 part of benzoyl peroxide by suspension polymerization in the same manner as in Polymer Synthesis Example 6. The resulting copolymer had a weight-average molecular weight (Mw) of 221,000 and a peak molecular weight(MA) of 198,000 as shown in Table 3. This polymer is referred to as the Comparative Polymer B-1 for the binder resin.

Examples of production of the binder resin are described below which is used for the toner of the present invention.

Binder Resin Production Example 1

As shown in Table 4, 70 parts of the Polymer A-1, and 30 parts of the Polymer B-1 were added to 200 parts of xylene with stirring. This mixture was heated to about 60° C. to dissolve the Polymer A-1 and the Polymer B-1 completely. After stirring for about 2 hours, xylene was removed, giving the Binder Resin-1.

Binder Resin Production Examples 2–8, and Comparative Binder Resin Production Examples 1–3

The Binder Resins 2–8 for the toner of the present invention, and the Comparative Binder Resins 1–3 for comparison were produced in the same manner as in Binder Resin Production Example 1 except that the polymers shown in Table 4 were used.

Example 1

| | |
|---|---|
| Binder Resin-1 | 100 parts |
| Carbon black | 4.5 parts |
| Quaternary ammonium salt | 1.5 parts |
| Graft-modified wax | 4 parts |

The above materials were mixed preliminarily by means of a Henschel mixer. The mixture was blended by melting at 130° C. with a double-screw kneading extruder. The blended mixture was pulverized with an air-stream grinder, and classified with a pneumatic classifier to give a black fine powdery matter (a black toner) having a weight average-particle diameter of 12.0 μm. To 100 parts of the black fine powdery matter (the toner), 1.2 parts of silica having been treated with amino-modified silicone oil was externally added to give a non-magnetic one-component type developer.

The graft-modified wax used as the releasing agent in this example was a styrene-modified polyethylene wax having a number-average-molecular weight (Mn) of 550, a weight-average molecular weight (Mw) of 880, the ratio of weight-average molecular weight to number-average molecular weight (Mw/Mn) of 1.6, and a melting point of 92° C.

The binder resin used in this example, as shown in Table 5, contains a THF-insoluble portion at a content of 2.1% by weight. The THF-soluble portion had the ratio of weight-average molecular weight to number-average molecular weight (Mw/Mn) of 25.3, a molecular weight peak MA of 12,000, a molecular weight peak MB of 684,000, the ratio of MB/MA of 57, and the ratio of the areas defined by the molecular weight distribution curve, SA:SB:Sd of 1:0.34:0.49 according to GPC measurement.

The above-mentioned non-magnetic one-component type developer was evaluated using a copying machine FC-2 (made by Canon K.K.) having a modified developing device in which a feeding roller 113 made of urethane rubber was set in contact with the developer-carrying member with pressure, and the developer-applying blade 111 made of silicone rubber instead of iron was set to come in contact with pressure with the developer-carrying member as shown in FIG. 6. The developing conditions were as shown below.

| | |
|---|---|
| Toner layer thickness on developer-carrying member 104: | 32 μm |
| Gap between developer carrier 104 and latent image-supporting member 101: | 250 μm |
| Pressure of contact (linear pressure) between developer-carrying member 104 and developer-applying blade 111: | 20 g/cm |
| Alternate current bias: | f = 1800 Hz, Vpp = 1200 V |
| Direct current bias: | −270 V |
| Development contrast: | 330 V |
| Latent image-supporting member: | OPC photosensitive member (negative latent image) |

Even after the endurance test of continuous copying of 5000 sheets, neither melt adhesion of the toner on the developer carrying member and the photosensitive member (the latent image-supporting member) nor image deterioration such as occurrence of fogging and decrease of the image density was observed, and the anti-offset property was satisfactory without back staining. The fixability was evaluated using an image fixed by a fixer (FC-2) whose temperature was set lower by 30° C., rubbing the fixed image with lint-free paper with a pressure of 50 g/cm$^2$ back and forth 10 times, and observing the degree of decrease of the density. The result was excellent with the degree of decrease of the density as, low as 5.7%.

Example 2

| | |
|---|---|
| Binder Resin-2 | 100 parts |
| Monoazo type red pigment | 3.5 parts |
| Salicylic acid-metal complex | 1.5 parts |
| Graft-modified wax | 4 parts |

With the above, materials, a red fine powdery matter (a red toner) was prepared in the same manner as in Example 1. To 100 parts of the red fine powdery matter (the red toner), 1 parts of silica having been treated for hydrophobicity was externally added to give a non-magnetic one-component type developer.

The graft-modified wax used as the releasing agent in this example was a polyethylene wax modified by grafting of styrene and dibutyl fumarate, having a number-average-molecular weight (Mn) of 690, a weight-average molecular weight (Mw) of 1350, the ratio of weight-average molecular weight to number-average molecular weight (Mw/Mn) of 2.0, and a melting point of 106° C.

The binder resin used in this example, as shown in Table 5, contains a THF-insoluble portion at a content of 3.5% by weight. The THF-soluble portion had the ratio of weight-average molecular weight to number-average molecular weight (Mw/Mn) of 30.8, a molecular weight peak MA of 11,000, a molecular weight peak MB of 587,000, the ratio of MB/MA of 53.36, and the ratio of the areas defined by the molecular weight distribution curve, SA:SB:Sd of 1:0.42:0.54 according to GPC measurement.

The above-mentioned non-magnetic one-component type developer was evaluated by means of a laser beam printer LBP-8 II (made by Canon K.K.) having a modified developing device in which a feeding roller 113 made of urethane rubber is provided so as to come in contact with the developer-carrying member with pressure, and the developer-applying blade 111 made of silicone rubber instead of iron was set to come in contact with the developer-carrying member with pressure as shown in FIG. 6. The developing conditions were as shown below.

| | |
|---|---|
| Toner layer thickness on developer-carrying member 104: | 40 μm |
| Gap between developer-carrying member 104 and latent image holding member 101: | 270 μm |
| Pressure of contact (linear pressure) between developer carrying member 104 and developer-applying blade 111: | 30 g/cm |
| Alternate current bias: | f = 1400 Hz, Vpp = 1800 V |
| Direct current bias: | −450 V |
| Development contrast: | 300 V |
| Latent image holding member: | OPC photosensitive member (negative latent image) |

Even after the endurance test of continuous copying of 8000 sheets, neither melt adhesion of the toner on the developer carrying member and the photosensitive member (the latent image holding member) nor image deterioration such as fogging or decrease of the image density was observed, and the anti-offset property was satisfactory and back staining was not observed. The fixability was evaluated in the same manner as in Example 1 except that the temperature setting of the fixation device of LBP-8 II was set lower by 20° C. Consequently, the result was excellent with the density decrease degree of 68%.

Examples 3–5

Non-magnetic one-component type developers were prepared in the same manner as in Example 1 except that the binder resin and the releasing agent were changed as shown in Table 5. The evaluation results are shown in Table 6.

Examples 6–8

Non-magnetic one-component type developers were prepared in the same manner as in Example 2 except that the binder resin and the releasing agent were changed as shown in Table 5. The evaluation results are shown in Table 6.

Comparative Example 1

Non-magnetic one-component type developers were prepared in the same manner as in Example 1 except that the Comparative binder resin-1 was used in place of the Binder resin-1. Evaluation was made in the same manner as in Example 1. As shown in Table 6, after the endurance test of continuous copying of 700 sheets, melt-adhesion of the toner on the developer carrying member occurred and considerable fogging on the image was observed. Further, offset arose at high temperature and staining on the back side was observed, although in the fixation test, the density decrease degree was satisfactorily 2.1%.

The binder resin used in this Comparative example contained a THF-insoluble portion at a content of 0.8% by weight. The THF-soluble portion had the ratio of weight-average molecular weight to number-average molecular weight (Mw/Mn) of 53, a peak molecular weight MA of 2850, a peak molecular weight MB of 702,000, the ratio of MB/MA of 246, and the ratio of the areas defined by the molecular weight distribution curve, SA:SB:Sd of 1:0.42:1.1.

Comparative Examples 2 and 3

Non-magnetic one-component type developers were prepared in the same manner as in Example 2 except that the binder resin and the releasing agent were changed as shown in Table 5. The evaluation results are shown in Table 6.

Polymer Synthesis Example 11

In a reactor, 200 parts of xylene was placed, and was heated up to the reflux temperature. Thereto a mixture of 83 parts of styrene, 17 parts of butyl acrylate and 6 parts of di-tert-butyl peroxide was added dropwise at 130° C. in 3 hours. The solution polymerization was completed by refluxing xylene. Then xylene was removed. The resulting styrene-butyl acrylate copolymer had a weight-average molecular weight (Mw) of 14,000 and a peak molecular weight (MA) at 12,000 as shown in Table 7. This polymer is referred to as the Polymer A-6 for the binder resin of the present invention.

Polymer Synthesis Examples 12–15

The Polymers A-7 to A-10 for the binder resins of the present invention were prepared by solution polymerization in the same manner as in Polymer Synthesis Example 11 except that the monomer composition, the polymerization initiator, and the solvent shown in Table 7 were used.

Polymer Synthesis Example 16

In a reactor, 200 parts of degassed water containing 0.2 parts of polyvinyl alcohol dissolved therein was placed, and thereto 77 parts of styrene, 23 parts of butyl acrylate, and 0.1 part of 1,1-bis(1-butylperoxy)-3,3,5-trimethylcyclohexane was added to prepare a liquid suspension. The liquid suspension was heated and kept at 8° C. in a nitrogen atmosphere for 24 hours to complete the polymerization reaction. The reaction mixture was cooled to room temperature. The polymer formed was collected by filtration, washed sufficiently with water, dehydrated, and dried. The resulting styrene-butyl acrylate copolymer had a weight-average molecular weight (Mw) at 915,000 end a peak molecular weight (MB) at 723,000 as shown in Table 8. This polymer is referred to as the polymer B-6 of the present invention.

Polymer Synthesis Examples 17–20

The binder resins B-7 to B-10 were prepared by suspension polymerization in the same manner as in Polymer Synthesis Example 16 except that the monomer composition, and the polymerization initiator shown in Table 8 were used.

Comparative Polymer Synthesis Example 3

A styrene-butyl acrylate copolymer was prepared from 93 parts of styrene, 7 parts of butyl acrylate, and 10 parts of di-tert-butyl peroxide by solution polymerization in the same manner as in Polymer Synthesis Example 1. The resulting copolymer had a weight-average molecular weight (Mw) of 3,300 and a peak molecular weight (MA) at 3,000 as shown in Table 9. This polymer is referred to as the Comparative Polymer A-2 for the comparative binder resin.

Comparative Polymer Synthesis Example 4

A styrene-butyl acrylate copolymer was prepared from 78 parts of styrene, 22 parts butyl acrylate, 0.2 part of divinylbenzene, and 0.8 part of benzoyl peroxide by suspension polymerization in the same manner as in Polymer Synthesis Example 16. The resulting copolymer had a weight-average molecular weight (Mw) of 196,000 and a peak molecular weight (MB) at 175,000 as shown in Table 9. This polymer is referred to as the Comparative Polymer B-2 for the binder resin.

Examples of production of the binder resin are described below which is used for the toner of the present invention.

Binder Resin Production Example 9

As shown in Table 10, 70 parts of the Polymer A-6, and 30 parts of the Polymer B-6 were added to 200 parts of xylene with stirring. This mixture was heated to about 60° C. to completely dissolve the Polymer A-6 and the Polymer B-6. After stirring for about 2 hours, the xylene was removed, giving the Binder Resin-9.

Binder Resin Production Examples 10–16, and Comparative Binder Resin Production Examples 4–6

The Binder Resins 10–16 for the toner of the present invention, and the Comparative Binder Resins 4–6 for comparison were produced in the same manner as in Binder Resin Production Example 9 except that the polymers shown in Table 10 were used.

Example 9

| | |
|---|---|
| Binder Resin-9 | 100 parts |
| Carbon black | 4 parts |
| Quaternary ammonium salt | 2.5 parts |
| Graft-modified wax | 4.5 parts |

The above materials were mixed preliminarily by means of a Henschel mixer. The mixture was melt-kneaded at 130° C. with a double-screw kneading extruder. The blended mixture was pulverized with an air-stream grinder, and classified with a pneumatic classifier to give a black fine powdery matter (a black toner) having a weight average-particle diameter of 12.0 μm. To 100 parts of the black fine powdery matter (the toner), 1.2 parts of silica treated with amino-modified silicone oil was externally added to give a non-magnetic one-component type developer.

The graft-modified wax used as the releasing agent in this example was a styrene-modified polyethylene wax having a number-average-molecular weight (Mn) of 1,100, a weight-average molecular weight (Mw) of 1,270, the ratio of weight-average molecular weight to number-average molecular weight (Mw/Mn) of 1.15, and a melting point of 99° C.

The binder resin used in this example, as shown in Table 11, contains a THF-insoluble portion at a content of 2.5% by weight The THF-soluble portion had the ratio of weight-average molecular weight to number-average molecular weight (Mw/Mn) of 24.2, a peak molecular weight MA at 12,000, a peak molecular weight MB at 705,000, the ratio of MB/MA of 58.75, and the ratio of the areas defined by the molecular weight distribution curve, SA:SB:Sd of 1:0.32:0.55 according to GPC measurement.

The above-mentioned non-magnetic one-component type developer was evaluated using a copying machine FC-2 (made by Canon K.K.) having a modified developing device in which a feeding roller 113 made of urethane rubber is provided so as to come in contact with the developer-carrying member with pressure, and the developer-applying blade 111 made of silicone rubber instead of iron was set to come in contact with the developer-carrying member with pressure as shown in FIG. 6. The developing conditions were as shown below.

| | |
|---|---|
| Toner layer thickness on developer-carrying member 104: | 32 μm |
| Gap between developer-carrying member 104 and latent image holding member 101: | 250 μm |
| Pressure of contact (linear pressure) between developer-carrying member 104 and developer-applying blade 111: | 20 g/cm |
| Alternate current bias: | f = 1800 Hz, Vpp = 1200 V |
| Direct current bias: | −270 V |
| Development contrast: | 330 V |
| Latent image holding member: | OPC photosensitve member (negative latent image) |

Even after the endurance test of continuous copying of 5000 sheets, neither melt adhesion of the toner on the developer carrying member and the photosensitive member (the latent image holding member) nor image deterioration such as fogging or decrease of the image density was observed, and the anti-offset property was satisfactory without back staining. The fixability was evaluated using an image fixed by a fixer (FC-2) whose temperature was set lower by 30° C., rubbing the fixed image with lint-free paper with a pressure of 50 g/cm$^2$ back and forth 10 times, and observing the degree of decrease of the density. The result was excellent with the degree of decrease of the density as low as 5.4%.

Example 10

| | |
|---|---|
| Binder Resin-10 | 100 parts |
| Copper phthalocyanine blue | 4 parts |

-continued

| | |
|---|---|
| Salicylic acid-metal complex | 2.0 parts |
| Graft-modified wax | 3.5 parts |

From the above materials, a blue fine powdery matter (a toner) was prepared in the same manner as in Example 1. To 100 parts of the blue fine powdery matter, 1 parts of silica having been treated for hydrophobicity was externally added to give a non-magnetic one-component type developer.

The graft-modified wax used as the releasing agent in this example was a polyethylene wax modified by grafting of dibutyl fumarate, having a number-average-molecular weight (Mn) of 950, a weight-average molecular weight (Mw) of 1,940, the ratio of weight-average molecular weight to number-average molecular weight (Mw/Mn) of 2.04, and a melting point of 97° C.

The binder resin used in this example, as shown in Table 5, contains a THF-insoluble portion at a content of 3.4% by weight. The THF-soluble portion had the ratio of weight-average molecular weight to number-average molecular weight (Mw/Mn) of 27.1, a peak molecular weight MA at 11,000, a peak molecular weight MB at 643,000, the ratio of MB/MA of 58.45, and the ratio of the areas defined by the molecular weight distribution curve, SA:SB:Sd of 1:0.38:0.58 according to GPC measurement.

The above-mentioned non-magnetic one-component type developer was evaluated by means of a laser beam printer LBP-8 II (made by Canon K.K.) having a modified developing device in which a feeding roller 113 made of urethane rubber is provided so as to come in contact with the developer-carrying member with pressure, and the developer-applying blade 111 made of silicone rubber instead of iron was set to come in contact with the developer-carrying member with pressure as shown in FIG. 6. The developing conditions were as shown below.

| | |
|---|---|
| Toner layer thickness on developer-carrying member 104: | 40 μm |
| Gap between developer-carrying member 104 and latent image holding member 101: | 270 μm |
| Pressure of contact (linear pressure) between developer carrying member 104 and developer-applying blade 111: | 30 g/cm |
| Alternate current bias: | f = 1400 Hz, Vpp = 1800 V |
| Direct current bias: | −450 V |
| Development contrast: | 300 V |
| Latent image holding member: | OPC photosensitive member (negative latent image) |

Even after the endurance test of continuous copying of 8000 sheets, neither melt adhesion of the toner on the developer carrying member and the photosensitive member (the latent image holding member) nor image deterioration such as fogging or decrease of the image density was observed, and the anti-offset property was satisfactory without back staining. The fixability was evaluated in the same manner as in Example 9 except that the temperature of the fixation device of LBP-8 II was set lower by 20° C. Consequently, the result was excellent with the density decrease degree of 6.2%.

Examples 11–13

Non-magnetic one-component type developers were prepared in the same manner as in Example 9 except that the binder resin and the releasing agent were changed as shown in Table 11. The evaluation results are shown in Table 12.

Examples 14–16

Non-magnetic one-component type developers were prepared in the same manner as in Example 10 except that the binder resin and the releasing agent were changed as shown in Table 11. The evaluation results are shown in Table 12.

Comparative Example 4

Non-magnetic one-component type developers were prepared in the same manner as in Example 9 except that the Comparative binder resin-4 was used in place of the Binder resin-9. Evaluation was made in the same manner as in Example 9. As shown in Table 12, after the endurance test of continuous copying of 700 sheets, melt adhesion of the toner on the developer carrying member occurred and considerable fogging of the image was observed. Further, offset at high temperature arose and staining on the back side was observed, although the density decrease degree was 1.8% at the fixation test, and was highly satisfactory.

The binder resin used in this Comparative example contains a THF-insoluble portion at a content of 0.5% by weight. The THF-soluble portion had the ratio of weight-average molecular weight to number-average molecular weight (Mw/Mn) of 49, a peak molecular weight MA at 2,650, a peak molecular weight MB of 712,000, the ratio of MB/MA at 269, and the ratio of the areas defined by the molecular weight distribution curve, SA:SB:Sd of 1:0.42:1.1.

Comparative Examples 5 and 6

Non-magnetic one-component type developers were prepared in the same manner as in Example 10 except that the binder resin and the releasing agent were changed as shown in Table 11. The evaluation results are shown in Table 12.

Polymer Synthesis Example 21

In a reactor, 200 parts of xylene was placed, and was heated up to the reflux temperature. Thereto a mixture of 87 parts of styrene, 13 parts of butyl acrylate and 4.5 parts of benzoyl peroxide was added dropwise in 3 hours. The solution polymerization was completed under reflux of xylene. Then xylene was removed. The resulting styrene-butyl acrylate copolymer had a weight-average molecular weight (Mw) of 30,000 and a peak molecular weight (MA) at 28,000 as shown in Table 13. This polymer is referred to as the Polymer A-11 for the binder resin of the present invention.

Polymer Synthesis Examples 12–15

The Polymers A-12 to A-15 for the binder resins of the present invention were prepared by solution polymerization in the same manner as in Polymer Synthesis Example 21 except that the monomer composition, the polymerization initiator, and the solvent shown in Table 13 were used.

Polymer Synthesis Example 26

In a reactor, 200 parts of degassed water containing 0.2 parts of polyvinyl alcohol dissolved therein was placed, and thereto 80 parts of styrene, 20 parts of butyl acrylate, and 0.12 part of 1,1-bis(t-butylperoxy)cyclohexane was added to prepare a liquid suspension. The liquid suspension was heated and kept at 78° C. in a nitrogen atmosphere for 24 hours to complete the polymerization reaction. The reaction mixture was cooled to room temperature. The polymer was collected by filtration, washed sufficiently with water, dehydrated, and dried. The resulting styrene-butyl acrylate copolymer had a weight-average molecular weight (Mw) of 703,000 and a peak molecular weight (MB) at 625,000 as shown in Table 14. This polymer is referred to as the polymer B-11 of the present invention.

Polymer Synthesis Examples 27–30

The binder resins B-12 to B-15 were prepared by, suspension polymerization using the monomer composition, and the polymerization initiator shown in Table 14 in the same manner as in Polymer Synthesis Example 26.

Comparative Polymer Synthesis Example 5

A styrene-butyl acrylate copolymer was prepared by solution polymerization in the same manner as Polymer Synthesis Example 21 except that 85 parts of styrene, 15 parts of butyl acrylate, and 10 parts of azobisisobutyronitrile were used and toluene was used as the solvent, and the reaction temperature was 110° C. The resulting copolymer had a weight-average molecular weight (Mw) of 56,000 and a peak molecular weight (MA) at 52,000 as shown in Table 15. This polymer is referred to as the Comparative Polymer A-3 for the comparative binder resin.

Examples of production of the binder resin are described below which is used for the toner of the present invention.

Binder Resin Production Example 17

As shown in Table 16, 70 parts of the Polymer A-11, and 30 parts of the Polymer B-11 were added to 200 parts of xylene with stirring. This mixture was heated to about 60° C. to dissolve the Polymer A-11 and the Polymer B-11 completely. After stirring for about 2 hours, xylene was removed, giving the Binder Resin-17.

Binder Resin Production Examples 18–24 and Comparative Binder Resin Production Examples 7–9

The Binder Resins 18–24 for the toner of the present invention, and the Comparative Binder Resins 7–9 for comparison were produced in the same manner as in Binder Resin Production Example 17 except that the polymers shown in Table 16 were used.

Example 17

| | |
|---|---|
| Binder Resin-17 | 100 parts |
| Carbon black | 4 parts |
| Quaternary ammonium salt | 2 parts |
| Low molecular weight polypropylene | 4 parts |

The above materials were preliminarily mixed by means of a Henschel mixer. The mixture was melt-kneaded at 130° C. with a double-screw kneading extruder. The blended mixture was pulverized with an air-stream grinder, and classified with a pneumatic classifier to give a black fine powdery matter (a black toner) having a weight average-particle diameter of 12.0 μm. To 100 parts of the black fine powdery matter, 1.2 parts of silica treated with amino-modified silicone oil was externally added to give a developer.

The low molecular weight polypropylene used as the releasing agent in this example had a number-average-molecular weight (Mn) of 2,200, a weight-average molecular weight (Mw) of 6,300, the ratio of weight-average molecular weight to number-average molecular weight (Mw/Mn) of 2.9, and a melting point of 148° C.

The binder resin used in this example, as shown in Table 17, contains a THF-insoluble portion at a content of 1.9% by weight. The THF-soluble portion had the ratio of weight-average molecular weight to number-average molecular weight (Mw/Mn) of 17.5, a peak molecular weight MA at 29,000, a peak molecular weight MB at 619,000, the ratio of MB/MA of 21.3, and the ratio of the areas defined by the molecular weight distribution curve, SA:SB:Sd of 1:0.35:0.30 according to GPC measurement.

The above-mentioned non-magnetic one-component type developer was evaluated by means of a copying machine FC-2 (made by Canon K.K.) having a modified developing device in which a feeding roller 113 made of urethane rubber is provided so as to come in contact with the developer-carrying member with pressure, and the developer-applying blade 111 made of silicone rubber instead of iron was set to come in contact with the developer-carrying member with pressure as shown in FIG. 6. The developing conditions were as shown below.

| | |
|---|---|
| Toner layer thickness on developer-carrying member 104: | 32 μm |
| Gap between developer-carrying member 104 and latent image holding member 101: | 250 μm |
| Pressure of contact (linear pressure) between developer-carrying member 104 and developer-applying blade 111: | 20 g/cm |
| Alternate current bias: | f = 1800 Hz, Vpp = 1200 V |
| Direct current bias: | −270 V |
| Development contrast: | 330 V |
| Latent image holding member: | OPC photosensitive member (negative latent image) |

Even after the endurance test of continuous copying of 5000 sheets, neither melt adhesion of the toner on the developer carrying member or the photosensitive member (the latent image holding member) nor image deterioration such as fogging or decrease of the image density was observed, and the anti-offset property was satisfactory without back staining. The fixability was evaluated using an image fixed by a fixer (FC-2) whose temperature was set lower by 30° C., rubbing the fixed image with lint-free paper with a pressure of 50 g/cm$^2$ back and forth 10 times, and observing the degree of decrease of the density. The result was excellent with the degree of decrease of the density of 7.5%.

Example 18

| | |
|---|---|
| Binder Resin-18 | 100 parts |
| Copper phthalocyanine pigment | 4 parts |
| Salicylic acid-metal complex | 1.5 parts |
| Graft-modified wax | 4 parts |

From the above materials, a blue fine powdery matter (a toner) was prepared in the same manner as in Example 17. To 100 parts of the blue fine powdery matter, 1 parts of silica treated for hydrophobicity was externally added to give a non-magnetic one-component type developer.

The graft-modified wax used as the releasing agent in this example was a polyethylene wax modified by grafting of styrene and dibutyl fumarate, having a number-average-molecular weight (Mn) of 1,200, a weight-average molecular weight (Mw) of 2,550, the ratio of weight-average molecular weight to number-average molecular weight (Mw/Mn) of 2.1, and a melting point of 103° C.

The binder resin used in this example, as shown in Table 17, contains a THF-insoluble portion at a content of 3.2% by weight The THF-soluble portion had the ratio of weight-average molecular weight to number-average molecular weight (Mw/Mn) of 16.3, a peak molecular weight MA at 20,000, a peak molecular weight MB at 499,000, the ratio of MB/MA of 24.95, and the ratio of the areas defined by the molecular weight distribution curve, SA:SB:Sd of 1:0.30:0.29 according to GPC measurement.

The above-mentioned non-magnetic one-component type developer was evaluated using a laser beam printer LBP-8 II (made by Canon K.K.) having a modified developing device in which a feeding roller 113 made of urethane rubber is provided so as to come in contact with the developer-carrying member with pressure, and the developer-applying blade 111 made of silicone rubber instead of iron was set to come in contact with the developer-carrying member with pressure as shown in FIG. 6. The developing conditions were as shown below.

| | |
|---|---|
| Toner layer thickness on developer-carrying member 104: | 40 μm |
| Gap between developer-carrying member 104 and latent image holding member 101: | 270 μm |
| Pressure of contact (linear pressure) between developer carrying member 104 and developer-applying blade 111: | 30 g/cm |
| Alternate current bias: | f = 1400 Hz, Vpp = 1800 V |
| Direct current bias: | −450 V |
| Development contrast: | 300 V |
| Latent image holding member: | OPC photosensitive member (negative latent image) |

Even after the endurance test of continuous copying of 8000 sheets, neither melt adhesion of the toner on the developer carrying member and the photosensitive member (the latent image holding member) nor image deterioration such as fogging or decrease of the image density was observed, and the anti-offset property was satisfactory without back staining. The fixability was evaluated in the same manner as in Example 17 except that the temperature of the fixation device of LBP-8 II was set lower by 20° C. Consequently, the result was excellent with the density decrease degree of 6.5%.

Examples 19–21

Non-magnetic one-component type developers were prepared in the same manner as in Example 1 except that the binder resin and the releasing agent were changed as shown in Table 17. The evaluation results are shown in Table 18.

Examples 22–24

Non-magnetic one-component type developers were prepared in the same manner as in Example 18 except that the binder resin and the releasing agent were changed as shown in Table 17. The evaluation results are shown in Table 18.

Comparative Example 7

Non-magnetic one-component type developers were prepared in the same manner as in Example 17 except that the Comparative binder resin-7 was used in place of the Binder resin-17.

The efficiency in the grinding process during the production (namely, a relative feed quantity for obtaining the same particle diameter at the same grinding air-pressure) was undesirably as low as 72, taking feed quantity in Example 17 as 100.

Further the evaluation was conducted in the same manner as in Example 17. After endurance test of continuous copying of 8000 sheets, the image deterioration was not observed and the anti-offset property was good. However, the density decrease degree at the fixation test was extremely poor and as low as 18.8% as shown in Table 18.

The binder resin used in this Comparative example contains a THF-insoluble portion at a content of 2.2% by weight as shown in Table 17. The THF-soluble portion had the ratio of weight-average molecular weight to number-average molecular weight (Mw/Mn) of 14.5, a peak molecular weight MA at 51,000, a peak molecular weight MB at 612,000, the ratio of MB/MA of 12.0, and the ratio of the areas defined by the molecular weight distribution curve, SA:SB:Sd of 1:0.21:0.18.

Comparative Examples 8 and 9

Non-magnetic one-component type developers were prepared in the same manner as in Example 18 except that the binder resin and the releasing agent are changed as shown in Table 17. The evaluation results are shown in Table 18.

Comparative Example 10

| | |
|---|---|
| Polymer A-11 | 70 parts |
| Polymer B-11 | 30 parts |
| Carbon black | 4 parts |
| Quaternary ammonium salt | 2 parts |
| Low molecular weight polypropylene (as used in Example 17) | 4 parts |

Form the materials above, non-magnetic one component type developer was prepared in the same manner as in Example 17. The evaluation results are shown in Table 18.

Polymer Synthesis Example 31

In a reactor, 200 parts of xylene was placed, and was heated up to the reflux temperature. Thereto a mixture of 85 parts of styrene monomer, 15 parts of butyl acrylate and 5.5 parts of di-tert-butyl peroxide was added dropwise a 130° C. in 3 hours. The solution polymerization was completed by refluxing the xylene. Then the xylene was removed. The resulting styrene-butyl acrylate copolymer had a weight-average molecular weight (Mw) of 14,000 and a peak molecular weight (MA) at 12,000 as shown in Table 19. This polymer is referred to as the Polymer A-16 for the binder resin of the present invention.

Polymer Synthesis Examples 32–35

The Polymers A-17 to A-20 for the binder resins of the present invention were prepared by solution polymerization in the same manner as in Polymer Synthesis Example 31 except that the monomer composition, the polymerization initiator, and the solvent shown in Table 19 were used.

Polymer Synthesis Example 36

In a reactor, 200 parts of degassed water containing 0.2 parts of polyvinyl alcohol dissolved therein was placed, and thereto 78 parts of styrene, 22 parts of butyl acrylate, and 0.15 part of benzoyl peroxide was added to prepare a liquid suspension. The liquid suspension was heated and kept at 80° C. in a nitrogen atmosphere for 24 hours to complete the polymerization reaction. The reaction mixture was cooled to room temperature. The polymer formed was collected by filtration, washed sufficiently with water, dehydrated, and dried. The resulting styrene-butyl acrylate copolymer had a weight-average molecular weight (Mw) of 915,000 and a peak molecular weight (MB) at 723,000 as shown in Table 20. This polymer is referred to as the polymer B-16 of the present invention.

Polymer Synthesis Examples 37–40

The binder resins B-17 to B-20 were prepared by suspension polymerization with the monomer composition, and the polymerization initiator shown in Table 20 in the same manner as in Polymer Synthesis Example 36.

Comparative Polymer Synthesis Example 6

A styrene-butyl acrylate copolymer was prepared from 94 parts of styrene, 6 parts of butyl acrylate, and 10 parts of di-tert-butyl peroxide by solution polymerization in the same manner as in Polymer Synthesis Example 31. The resulting copolymer had a weight-average molecular weight (Mw) of 3,550 and a peak molecular weight (MA) at 3,300 as shown in Table 21. This polymer is referred to as the Comparative Polymer A-4 for the comparative binder resin.

Comparative Polymer Synthesis Example 7

A styrene-butyl acrylate copolymer was prepared from 80 parts of styrene, 20 parts butyl acrylate, 0.2 part of divinylbenzene, and 0.8 part of benzoyl peroxide by suspension polymerization in the same manner as in Polymer Synthesis Example 36. The resulting copolymer had a weight-average molecular weight (Mw) of 203,000 and a peak molecular weight (MB) at 189,000 as shown in Table 21. This polymer is referred to as the Comparative Polymer B-3 for the binder resin.

Examples of production of the binder resin are described below which is used for the toner of the present invention.

Binder Resin Production Example 25

As shown in Table 22, 70 parts of the Polymer A-16, and 30 parts of the Polymer B-16 were added to 200 parts of xylene with stirring. This mixture was heated to about 60° C. to dissolve the Polymer A-16 and the Polymer B-16 completely. After stirring for about 2 hours, xylene was removed, giving the Binder Resin-25.

Binder Resin Production Examples 26–32 and Comparative Binder Resin Production Examples 10–12

The Binder Resins 26–32 for the toner of the present invention, and the Comparative Binder Resins 10–12 for comparison were produced in the same manner as in Binder Resin Production Example 25 except that the polymers shown in Table 22 were used.

Example 25

| | |
|---|---|
| Binder Resin-25 | 100 parts |
| Carbon black | 4 parts |
| Quaternary ammonium salt | 2 parts |
| Graft-modified wax | 4 parts |

The above materials were mixed preliminarily by means of a Henschel mixer. The mixture was melt-kneaded at 130° C. with a double-screw knead kind extruder. The blended mixture was pulverized with an air-stream grinder, and classified with a pneumatic classifier to give a black fine powdery matter (a black toner) having a weight average-particle diameter of 12.0 μm. To 100 parts of the black fine powdery matter, 1.2 parts of silica treated with amino-modified silicone oil was externally added to give a non-magnetic one-component type developer.

The graft-modified wax used as the releasing agent in this example was a styrene-modified polyethylene wax having a number-average-molecular weight (Mn) of 600, a weight-average molecular weight (Mw) of 930, the ratio of weight-average molecular weight to number-average molecular weight (Mw/Mn) of 1.55, and a melting point of 98° C.

The binder resin used in this example, as shown in Table 23, contains a THF-insoluble portion at a content of 2.3% by weight. The THF-soluble portion had the ratio of weight-average molecular weight to number-average molecular weight (Mw/Mn) of 23.8, a peak molecular weight MA at 13,000, a peak molecular weight MB at 718,000, the ratio of MB/MA of 55.2, and the ratio of the areas defined by the molecular weight distribution curve, SA:SB:Sd of 1:0.34:0.49 according to GPC measurement.

The above-mentioned non-magnetic one-component type developer was evaluated using a copying machine FC-2 (made by Canon K.K.) having a modified developing device in which a feeding roller 113 made of urethane rubber is provided so as to come in contact with the developer-carrying member with pressure, and the developer-applying blade 111 made of silicone rubber instead of iron was set to come in contact with the developer-carrying member with pressure as shown in FIG. 6. The developing conditions were as shown below.

| | |
|---|---|
| Toner layer thickness on developer-carrying member 104: | 32 μm |
| Gap between developer-carrying member 104 and latent image holding member 101: | 250 μm |
| Pressure of contact (linear pressure) between developer-carrying member 104 and developer-applying blade 111: | 20 g/cm |
| Alternate current bias: | f = 1800 Hz, Vpp = 1200 V |
| Direct current bias: | −270 V |
| Development contrast: | 330 V |
| Latent image holding member: | OPC photosensitive member (negative latent image) |

Even after the endurance test of continuous copying of 5000 sheets, neither melt adhesion of the toner on the developer carrying member or the photosensitive member (the latent image holding member) nor image deterioration such as fogging or decrease of the image density was observed, and the anti-offset property was satisfactory without back staining. The fixability was evaluated using an image fixed by a fixer (FC-2) whose temperature was set lower by 30° C., rubbing the fixed image with lint-free paper with a pressure of 50 g/cm$^2$ back and forth 10 times, and observing the degree of decrease of the density. The result was excellent with the degree of decrease of the density of 6%.

Example 26

| | |
|---|---|
| Binder Resin-26 | 100 parts |
| Copper phthalocyanine pigment | 4 parts |
| Salicylic acid-metal complex | 1.5 parts |
| Graft-modified wax | 4 parts |

From the above materials, a blue fine powdery matter (a toner) was prepared in the same manner as in Example 1. To 100 parts of the blue fine powdery matter, 1 parts of silica treated for hydrophobicity was externally added to give a non-magnetic one-component type developer.

The graft-modified wax used as the releasing agent in this example was a polyethylene wax modified by grafting of styrene and dibutyl fumarate, having a number-average-molecular weight (Mn) of 650, a weight-average molecular weight (Mw) of 1,450, the ratio of weight-average molecular weight to number-average molecular weight (Mw/Mn) of 2.2, and a melting point of 103° C.

The binder resin used in this example, as shown in Table 23, contains a THF-insoluble portion at a content of 3.8% by weight. The THF-soluble portion had the ratio of weight-average molecular weight to number-average molecular weight (Mw/Mn) of 25.3, a peak molecular weight MA at 11,000, a peak molecular weight MB at 675,000, the ratio of MB/MA of 61.4, and the ratio of the areas defined by the molecular weight distribution curve, SA:SB:Sd of 1:0.43:0.61 according to GPC measurement.

The above-mentioned non-magnetic one-component type developer was evaluated using a laser beam printer LBP-8 II (made by Canon K.K.) having a modified developing device in which a feeding roller 113 made of urethane rubber is provided so as to come in contact with the developer-carrying member with pressure, and the developer-applying blade 111 made of silicone rubber instead of iron was set to come in contact with the developer-carrying member with pressure as shown in FIG. 6. The developing conditions were as shown below.

| | |
|---|---|
| Toner layer thickness on developer-carrying member 104: | 40 μm |
| Gap between developer-carrying member 104 and latent image holding member 101: | 270 μm |
| Pressure of contact (linear pressure) between developer carrying member 104 and developer-applying blade 111: | 30 g/cm |
| Alternate current bias: | f = 1400 Hz, Vpp = 1800 V |
| Direct current bias: | −450 V |
| Development contrast: | 300 V |
| Latent image holding member: | OPC photosensitive member (negative latent image) |

Even after the endurance test of continuous copying of 8000 sheets, neither melt adhesion of the toner on the developer carrying member or the photosensitive member (the latent image holding member) nor image deterioration such as fogging or decrease of the image density was observed, and the anti-offset property was satisfactory without back staining. The fixability was evaluated in the same manner as in Example 25 except that the temperature of the fixation device of LBP-8 II was set lower by 20° C. Consequently, the result was excellent with the density decrease degree of 6.5%.

Examples 27–29

Non-magnetic one-component type developers were prepared in the same manner as in Example 25 except that the binder resin and the releasing agent are changed as shown in Table 23. The evaluation results are shown in Table 24.

Examples 30–32

Non-magnetic one-component type developers were prepared in the same manner as in Example 26 except that the binder resin and the releasing agent are changed as shown in Table 23. The evaluation results are shown in Table 24.

Comparative Example 11

Non-magnetic one-component type developers were prepared in the same manner as in Example 25 except that the Comparative binder resin-10 was used in place of the Binder resin-25. Evaluation was made in the same manner as in Example 25. As shown in Table 24, after the endurance test of continuous copying of 700 sheets, melt-adhesion of the toner occurred on the developer carrying member and considerable fogging of the image was observed. Further, offset at high temperature arose and staining on the back side was observed, although the density decrease degree was satisfactorily 1.9% by the fixation test.

The binder resin used in this Comparative example contains a THF-insoluble portion at a content of 1.0% by weight, and the THF-soluble portion had the ratio of weight-average molecular weight to number-average molecular weight (Mw/Mn) of 28, a peak molecular weight MA at 2,800, a peak molecular weight MB at 718,000, the ratio of MB/MA of 256, and the ratio of the areas defined by the molecular weight distribution curve, SA:SB:Sd of 1:0.4:1.05.

Comparative Examples 12 and 13

Non-magnetic one-component type developers were prepared in the same manner as in Example 26 except that the binder resin and the releasing agent were changed as shown in Table 23. The evaluation results are shown in Table 24.

Polymer Synthesis Example 41

In a reactor, 200 parts of xylene was placed, and was heated up to the reflux temperature. Thereto a mixture of 82 parts of styrene monomer, 18 parts of butyl acrylate and 7 parts of di-tert-butyl peroxide was added. The solution polymerization was completed by refluxing the xylene for 5 hours. The resulting styrene-butyl acrylate copolymer (hereinafter referred to as St-BA copolymer) had a weight-average molecular weight (Mw) of 12,000, a ratio of weight-average molecular weight to number-average molecular weight (Mw/Mn) of 2.6, a flow-beginning temperature of 86° C., a softening point of 108° C., a glass transition temperature (Tg) of 54° C., and a peak molecular weight (MA) of 11,500 as shown in Table 25. This polymer is referred to as the Polymer A-21 for the binder resin of the present invention.

Polymer Synthesis Examples 42–46

The Polymers A-22 to A-26 for the binder resins of the present invention were prepared by solution polymerization in the same manner as in Polymer Synthesis Example 41 except that the monomer composition, the polymerization initiator, and the solvent shown in Table 25 were used.

Polymer Synthesis Example 47

In 200 parts of degassed water, 80 Parts of styrene monomer, 20 parts of butyl acrylate monomer, 0.2 parts of polyvinyl alcohol, and 0.12 part of benzoyl peroxide were mixed and dispersed. The liquid suspension was heated and kept at 80° C. in a nitrogen atmosphere for 24 hours to complete the polymerization reaction. The reaction mixture was cooled to room temperature. The polymer formed was collected by filtration, washed sufficiently with water, dehydrated, and dried. The resulting styrene-butyl acrylate copolymer had a weight-average molecular weight (Mw) of 580,000, a ratio of weight-average molecular weight to number-average molecular weight (Mw/Mn) of 2.7, a flow-beginning temperature of 120° C., a softening point of 170° C., a glass transition temperature (Tg) of 61.8° C., and a peak molecular weight (MB) at 570,000 as shown in Table 26. This polymer is referred to as the polymer B-21 of the present invention.

Polymer Synthesis Examples 48–52

The binder resins B-22 to B-25 were prepared by suspension polymerization with the monomer composition, and the polymerization initiator shown in Table 26 in the same manner as in Polymer Synthesis Example 46.

Comparative Polymer Synthesis Example 8

A styrene-butyl acrylate copolymer was prepared from 95 parts of styrene, 5 parts of butyl acrylate, and 10 parts of di-tert-butyl peroxide by solution polymerization in the same manner as in Polymer Synthesis Example 41. The resulting copolymer had a weight-average molecular weight (Mw) of 4,000, a ratio of weight-average molecular weight to number-average molecular weight (Mw/Mn) of 4.0, flow-beginning point of 72° C., softening point at 93° C., glass transition point at 52° C., and a peak molecular weight (MA) at 3,900 as shown in Table 27. This polymer is referred to as the Comparative Polymer A-15 for the comparative binder resin.

Comparative Polymer Synthesis Example 9

A styrene-butyl acrylate copolymer was prepared from 86 parts of styrene, 14 parts of butyl acrylate, 0.3 part of divinylbenzene, and 0.7 part of benzoyl peroxide by suspension polymerization in the same manner as in Polymer Synthesis Example 46. The resulting copolymer had a weight-average molecular weight (Mw) of 205,000, a ratio of weight-average molecular weight to number-average molecular weight (Mw/Mn) of 3.5, a flow-beginning temperature of 105° C., a softening point of 148° C., a glass transition temperature (Tg) of 53° C., and a peak molecular weight (MB) at 198,000 as shown in Table 27. This polymer is referred to as Comparative Polymer B-4 for the binder resin.

Examples of production of the binder resin are described below which is used for the toner of the present invention.

Binder Resin Production Example 33

As shown in Table 28, 70 parts of the Polymer A-21, and 30 parts of the Polymer B-21 were added to 200 parts of xylene with stirring. This mixture was heated to about 60° C. to dissolve the Polymer A-21 and the Polymer B-21 completely. After stirring for about 2 hours, xylene was removed, giving the Binder Resin-33.

Binder Resin Production Examples 34–41, and Comparative Binder Resin Production Examples 13–15

The Binder Resins 34–41 for the toner of the present invention, and the Comparative Binder Resins 13–15 for comparison were produced in the same manner as in Binder Resin Production Example 33 except that the polymers shown in Table 28 were used.

Example 33

| | |
|---|---|
| Binder Resin-33 | 100 parts |
| Aniline black | 4 parts |
| Quaternary ammonium salt | 2 parts |
| Graft-modified wax | 4 parts |

The mixture of the above materials was melt-kneaded with a double-screw kneading extruder. The blended mixture was pulverized with an air-stream grinder, and classified with a pneumatic classifier to give a black powdery matter (a black toner) having a weight average-particle diameter of 12.0 μm. To 100 parts of the black powdery matter (the toner), 1.5 parts of hydrophobic powdery silica was added to give a non-magnetic one-component type developer.

The graft-modified wax used as the releasing agent in this example was a polyethylene wax modified by grafting of styrene and butyl acrylate and having a number-average-molecular weight (Mn) of $5.3\times10^2$, a weight-average molecular weight (Mw) of $8.0\times10^2$, the ratio of weight-average molecular weight to number-average molecular weight (Mw/Mn) of 1.5, and a melting point of 92° C.

The binder resin used in this example, as shown in Table 29 contains a THF-insoluble portion at a content of 1.2% by weight The THF-soluble portion had the ratio of weight-average molecular weight to number-average molecular weight (Mw/Mn) of 26, a peak molecular weight MA at 11,000, a peak molecular weight MB at 565,000, the ratio of MB/MA of 51.4, and the ratio of the areas defined by the molecular weight distribution curve, SA:SB:Sd of 1:0.35:0.55 according to GPC measurement.

The above-mentioned non-magnetic one-component type developer was evaluated by means of a copying machine FC-2 (made by Canon K.K.) having a modified developing device in which a feeding roller 113 made of urethane rubber is provided so as to come in contact with the developer-carrying member with pressure, and the developer-applying blade 111 made of silicone rubber instead of iron was set to come in contact with the developer-carrying member with pressure as shown in FIG. 6. The developing conditions were as shown below.

| | |
|---|---|
| Toner layer thickness | 32 μm |

-continued

| | |
|---|---|
| on developer-carrying member 104: | |
| Gap between developer-carrying member 104 and latent image holding member 101: | 250 μm |
| Pressure of contact (linear pressure) between developer carrying member 104 and developer-applying blade 111: | 20 g/cm |
| Alternate current bias: | f = 1800 Hz, Vpp = 1200 V |
| Direct current bias: | −270 V |
| Development contrast: | 330 V |
| Latent image holding member: | OPC photosensitive member (negative latent image) |

Even after the endurance test of continuous copying of 3000 sheets, neither melt adhesion of the toner on the developer carrying member or the photosensitive member nor image deterioration such as fogging or decrease of the image density was observed.

The fixability was evaluated by use of a copying machine, NP1215 (made by Canon K.K.) modified by removing the fixing device. The fixation of the image was tested by using an external temperature-controllable hot fixing rollers employing a fluororesin (Teflon-commercial name) for the upper roller and a silicone rubber for the lower roller, under the conditions of a liner pressure of 0.4 kg/cm$^2$ between the upper and lower rollers with 4-mm nip, a processing speed of 50 mm/sec, and a temperature control range of from 100° to 230° C. The obtained fixed image was rubbed with a lintless paper sheet with a pressure of 50 g/cm$^2$. The temperature, at which the decrease of the image density after the rubbing becomes 7% or less compared with the image density before the rubbing, is considered as the fixation-starting temperature.

The anti-offset property was evaluated by observation of the image and the roller.

As a result, the fixation-starting temperature was as low as 130° C., and the non-offset region ranged from 130° C. to 220° C., thus low-temperature fixation being achieved.

The anti-blocking property was evaluated by leaving the toner in a drier at temperature of 50° C. for 3 days. The anti-blocking property was also satisfactory. The results are shown in Table 30.

Example 34

| | |
|---|---|
| Binder Resin-34 | 100 parts |
| Indanthrene blue | 4 parts |
| Dicarboxylic acid-metal complex | 2 parts |
| Graft-modified wax | 4 parts |

From the above materials, a blue powdery matter (a toner) was prepared in the same manner as in Example 33. To 100 parts of the blue powdery matter, 1.5 parts of silica treated with an amino-modified silicone oil was externally added to give a non-magnetic one-component type developer.

The graft-modified wax used as the releasing agent in this example was a polyethylene wax modified by grafting of styrene and monobutyl fumarate, having a number-average-molecular weight (Mn) of $6.2\times10^2$, a weight-average molecular weight (Mw) of $1.2\times10^3$, the ratio of weight-average molecular weight to number-average molecular weight (Mw/Mn) of 1.9, and a melting point of 98° C.

The binder resin used in this example, as shown in Table 29, contains a THF-insoluble portion at a content of 1.5% by weight. The THF-soluble portion had the ratio of weight-average molecular weight to number-average molecular weight (Mw/Mn) of 31, a peak molecular weight MA at 10,000, a peak molecular weight MB at 650,000, the ratio of MB/MA of 65, and the ratio of the areas defined by the molecular weight distribution curve, SA:SB:Sd of 1:0.39:0.58 according to GPC measurement.

The above-mentioned non-magnetic one-component type developer was evaluated in the same manner as in Example 33. The image density was high without fogging and without melt-adhesion. The fixation-starting temperature was 125° C., the non-offset region was from 125° to 220° C., and the anti-blocking property was satisfactory.

Examples 35–37

Non-magnetic one-component type developers were prepared in the same manner as in Example 33 except that the binder resin and the releasing agent were changed as shown in Table 29. The evaluation results are shown in Table 30.

Examples 38–41

Non-magnetic one-component type developers were prepared in the same manner as in Example 34 except that the binder resin and the releasing agent were changed as shown in Table 29. The evaluation results are shown in Table 30.

Comparative Example 14

Non-magnetic one-component type developers were prepared in the same manner as in Example 33 except that the Comparative binder resin-13 was used in place of the Binder resin-33. Evaluation was made in the same manner as in Example 33. As shown in Table 30, after the endurance test of copying of 500 sheets, considerable fogging of the image was observed.

The binder resin used in this Comparative example contains a THF-insoluble portion at a content of 1.3% by weight. The THF-soluble portion had the ratio of weight-average molecular weight to number-average molecular weight (Mw/Mn) of 39, a peak molecular weight MA at 3,800, a peak molecular weight MB at 565,000, the ratio of MB/MA of 149, and the ratio of the areas defined by the molecular weight distribution curve, SA:SB:Sd of 1:0.44:0.60.

Comparative Examples 15 and 16

Non-magnetic one-component type developers were prepared in the same manner as in Example 34 except that the binder resin and the releasing agent are changed as shown in Table 29. The evaluation results are shown in Table 30.

TABLE 1

Synthesis of Polymer A

| Polymer Synthesis Example | Polymer | Monomer Composition | | Solvent | Polymerization Initiator | Weight Average Molecular Weight | Peak Molecular Weight |
|---|---|---|---|---|---|---|---|
| 1 | A-1 | Styrene<br>Butyl acrylate | 82 part<br>18 part | Xylene | Di-t-butyl peroxide | 13000 | 11000 |

TABLE 1-continued

| Synthesis of Polymer A | | | | | | | |
|---|---|---|---|---|---|---|---|
| Polymer Synthesis Example | Polymer | Monomer Composition | | Solvent | Polymerization Initiator | Weight Average Molecular Weight | Peak Molecular Weight |
| 2 | A-2 | Styrene<br>Butyl acrylate | 84 part<br>16 part | Xylene | Benzoyl peroxide | 13700 | 10800 |
| 3 | A-3 | Styrene<br>Butyl acrylate | 78 part<br>22 part | Xylene | Benzoyl peroxide | 16200 | 14300 |
| 4 | A-4 | Styrene<br>2-ethylhexyl acrylate | 78 part<br>22 part | Toluene | Benzoyl peroxide | 20500 | 18800 |
| 5 | A-5 | Styrene<br>2-ethylhexyl acrylate | 75 part<br>25 part | Toluene | Benzoyl peroxide | 19400 | 17600 |

TABLE 2

| Synthesis of Polymer B | | | | | | |
|---|---|---|---|---|---|---|
| Polymer Synthesis Example | Polymer | Monomer Composition | | Polymerization Initiator | Weight Average Molecular eight | Peak Molecular Weight |
| 6 | B-1 | Styrene<br>Butyl acrylate | 80 part<br>20 part | Benzoyl peroxide | 915000 | 723000 |
| 7 | B-2 | Styrene<br>Butyl acrylate | 82 part<br>18 part | 1,4-bis(t-butylperoxy) cyclohexane | 597000 | 578000 |
| 8 | B-3 | Styrene<br>Butyl acrylate | 84 part<br>16 part | Dicumyl peroxide | 812000 | 789000 |
| 9 | B-4 | Styrene<br>2-ethylhexyl acrylate | 78 part<br>22 part | Dimethyl azoisobutylate | 971000 | 936000 |
| 10 | B-5 | Styrene<br>Butyl acrylate<br>Divinyl benzene | 82 part<br>18 part<br>0.5 part | Diethyl glycol-bis(t-butyl peroxy carbonate) | 770000 | 705000 |

TABLE 3

| Synthesis of Comparative Polymers A and B | | | | | | | |
|---|---|---|---|---|---|---|---|
| Comparative Polymer Synthesis Example | Comparative Polymer | Monomer Composition | | Solvent | Polymerization Initiator | Weight Average Molecular Weight | Peak Molecular Weight |
| 1 | Comp. polymer A-1 | Styrene<br>Butyl acrylate | 95 part<br>5 part | Xylene | Di-t-butyl peroxide | 36000 | 3350 |
| 2 | Comp. polymer B-1 | Styrene<br>Butyl acrylate<br>Divinyl benzene | 82 part<br>18 part<br>0.2 part | — | Benzoyl | 221000 | 198000 |

TABLE 4

| Synthesis of Binder Resin and Comparative Binder Resin | | | | |
|---|---|---|---|---|
| Production Example | Polymer A | | Polymer B | |
| Binder Resin 1 | A-1 | 70 part | B-1 | 30 part |
| Binder Resin 2 | A-2 | 66 part | B-5 | 34 part |
| Binder Resin 3 | A-3 | 72 part | B-4 | 28 part |
| Binder Resin 4 | A-4 | 55 part | B-3 | 45 part |
| Binder Resin 5 | A-5 | 68 part | B-4 | 32 part |
| Binder Resin 6 | A-4 | 60 part | B-4 | 40 part |
| Binder Resin 7 | A-2 | 70 part | B-3 | 30 part |

TABLE 4-continued

| Synthesis of Binder Resin and Comparative Binder Resin | | | | |
|---|---|---|---|---|
| Production Example | Polymer A | | Polymer B | |
| Binder Resin 8 | A-3 | 70 part | B-3 | 30 part |
| Comparative Binder Resin 1 | Comp. A-1 | 80 part | B-1 | 20 part |
| Comparative Binder Resin 2 | A-1 | 70 part | Comp. B-1 | 30 part |
| Comparative Binder Resin 3 | A-5 | 100 part | | 0 part |

TABLE 5

| Examples and Comparative Examples | | | | | | | | | | | |
|---|---|---|---|---|---|---|---|---|---|---|---|
| Exp. & Comp. Exp. | Binder Resin | THF Insoluble weight % | Mw/Mn | MA × $10^4$ | MB × $10^4$ | MB/MA | SA:SB:Sd | Releasing Agent Mn | MW | Mn/Mw | m.p. (°C.) |
| Example 1 | 1 | 2.1 | 25.3 | 1.2 | 68.4 | 57 | 1:0.34:0.49 | 550 | 880 | 1.6 | 92 |
| Example 2 | 2 | 3.5 | 30.8 | 1.1 | 58.7 | 53.36 | 1:0.42:0.54 | 690 | 1350 | 2.0 | 106 |
| Example 3 | 4 | 1.2 | 35 | 1.4 | 72 | 51 | 1:0.45:0.66 | 550 | 810 | 1.5 | 89 |
| Example 4 | 8 | 1.4 | 32 | 1.1 | 62.8 | 57 | 1:0.37:0.48 | 550 | 750 | 1.5 | 78 |
| Example 5 | 5 | 2.3 | 27 | 1.6 | 88.1 | 55 | 1:0.42:0.68 | 530 | 980 | 1.8 | 95 |
| Example 6 | 6 | 0.7 | 30 | 1.7 | 79 | 46 | 1:0.43:0.52 | 650 | 1450 | 2.2 | 102 |
| Example 7 | 7 | 1.0 | 45 | 0.84 | 65.2 | 78 | 1:0.35:0.5 | 1200 | 3480 | 2.9 | 120 |
| Example 8 | 3 | 1.5 | 25 | 1.5 | 78 | 52 | 1:0.3:0.62 | 600 | 930 | 1.55 | 98 |
| Compara- | Comparative | 0.8 | 53 | 0.285 | 70.2 | 246 | 1:0.42:1.1 | 550 | 880 | 1.6 | 92 |

TABLE 5-continued

| Exp. & Comp. Exp. | Binder Resin | THF Insoluble weight % | Mw/Mn | MA × $10^4$ | MB × $10^4$ | MB/MA | SA:SB:Sd | Releasing Agent Mn | MW | Mn/Mw | m.p. (°C.) |
|---|---|---|---|---|---|---|---|---|---|---|---|
| | Examples and Comparative Examples | | | | | | | | | | |
| tive Example 1 | Binder Resin 1 | | | | | | | | | | |
| Comparative Example 2 | Comparative Binder Resin 2 | 1.8 | 17 | 1.3 | 18.4 | 15 | 1:0.26:0.45 | 1300 | 4900 | 3.8 | 135 |
| Comparative Example 3 | Comparative Binder Resin 3 | 0 | 22 | 2.0 | — | — | — | 560 | 1150 | 2.1 | 109 |

TABLE 6

Result Estimation of Non-magnetic One-Component Developers of the Present Invention and Comparative Examples

| Examples and Comp. Examples | Fixability | Anti-offset Property | Image (Deterioration) | Melt-adhesion and Filming |
|---|---|---|---|---|
| Example 1 | 5.7 | Good | Good | None |
| Example 2 | 6.8 | Good | Good | None |
| Example 3 | 5.6 | Good | Good | None |
| Example 4 | 4.8 | Good | Good | None |
| Example 5 | 8.2 | Good | Good | None |
| Example 6 | 7.5 | Good | Good | None |
| Example 7 | 5.3 | Good | Good | None |
| Example 8 | 6.9 | Good | Good | None |
| Comparative Example 1 | 2.1 | Smear on Reverse | Fogging | Occurred on Developer-carrying member |
| Comparative Example 2 | 3.1 | Smear on Reverse | Fogging | Occurred on Developer-carrying member |
| Comparative Example 3 | 2.0 | Smear on Reverse | Fogging | Occurred on Developer-carrying member & Photosensitive Member (Latent image holding member) |

TABLE 7

Synthesis of Polymer A

| Polymer Synthesis Example | Polymer | Monomer Composition | | Solvent | Polymerization Initiator | Weight Average Molecular Weight | Peak Molecular Weight |
|---|---|---|---|---|---|---|---|
| 11 | A-6 | Styrene<br>Butyl acrylate | 83 part<br>17 part | Xylene | Di-t-butyl peroxide | 14000 | 12000 |
| 12 | A-7 | Styrene<br>Butyl acrylate | 86 part<br>14 part | Xylene | Benzoyl peroxide | 12000 | 9500 |
| 13 | A-8 | Styrene<br>Butyl acrylate | 76 part<br>24 part | Xylene | Benzoyl peroxide | 16000 | 15200 |
| 14 | A-9 | Styrene<br>2-ethylhexyl acrylate | 75 part<br>25 part | Toluene | Benzyl peroxide | 20000 | 18500 |
| 15 | A-10 | Styrene<br>2-ethylhexyl acrylate | 82 part<br>18 part | Toluene | Benzoyl peroxide | 25000 | 23500 |

TABLE 8

Synthesis of Polymer B

| Polymer Synthesis Example | Polymer | Monomer Composition | | Polymerization Initiator | Weight Average Molecular eight | Peak Molecular Weight |
|---|---|---|---|---|---|---|
| 16 | B-6 | Styrene<br>Butyl acrylate | 77 Part<br>23 part | 1,1-bis(1-butylperoxy) 3,3,5-trimethyl-cyclohexane | 915000 | 723000 |
| 17 | B-7 | Styrene<br>Butyl acrylate | 84 Part<br>16 part | 2,2-bis(t-butylperoxy) butane | 620000 | 603000 |
| 18 | B-8 | Styrene<br>Butyl acrylate | 86 part<br>14 part | Di-t-butylperoxy isophthalate | 832000 | 809000 |
| 19 | B-9 | Styrene<br>2-ethylhexyl acrylate | 80 part<br>20 part | Vinyl tris(t-butyl-peroxy) silane | 975000 | 940000 |
| 20 | B-10 | Styrene<br>Butyl acrylate | 78 part<br>22 part | 1,3-bis(t-butylperoxy-isopropyl)benzene | 728000 | 679000 |

TABLE 9

Synthesis of Comparative Polymer A and B

| Comparative Polymer Synthesis Example | Comp. Polymer | Monomer Composition | | Solvent | Polymerization Initiator | Weight Average Molecular Weight | Peak Molecular Weight |
|---|---|---|---|---|---|---|---|
| 3 | comp. A-2 | Styrene<br>Butyl acrylate | 93 part<br>7 part | Xylene | Di-t-butyl peroxide | 3300 | 3000 |
| 4 | Comp. B-2 | Styrene<br>Butyl acrylate<br>Divinyl benzene | 78 part<br>22 part<br>0.2 part | — | Benzoyl peroxide | 196000 | 175000 |

TABLE 10

Production of Binder Resins and Comparative Binder Resins

| Production Example | Polymer A | | Polymer B | |
|---|---|---|---|---|
| Binder Resin 9 | A-6 | 70 part | B-6 | 30 part |
| Binder Resin 10 | A-7 | 66 part | B-10 | 34 part |
| Binder Resin 11 | A-8 | 70 part | B-9 | 30 part |
| Binder Resin 12 | A-9 | 55 part | B-7 | 45 part |
| Binder Resin 13 | A-10 | 70 part | B-9 | 32 part |
| Binder Resin 14 | A-9 | 60 part | B-9 | 40 part |
| Binder Resin 15 | A-7 | 65 part | B-8 | 35 part |

TABLE 10-continued

Production of Binder Resins and Comparative Binder Resins

| Production Example | Polymer A | | Polymer B | |
|---|---|---|---|---|
| Binder Resin 16 | A-8 | 70 part | B-8 | 30 part |
| Comparative Binder Resin 4 | Comp. A-2 | 80 part | B-6 | 20 part |
| Comparative Binder Resin 5 | A-6 | 70 part | Comp. B-2 | 30 part |
| Comparative Binder Resin 6 | A-10 | 100 part | | 0 part |

TABLE 11

Examples and Comparative Examples

| Exp. & Comp. Exp. | Binder Resin | THF Insoluble weight % | Mw/Mn | MA × $10^4$ | MB × $10^4$ | MB/MA | SA:SB:Sd | Releasing Agent Mn | MW | Mn/Mw | m.p. (°C.) |
|---|---|---|---|---|---|---|---|---|---|---|---|
| Example 9 | 9 | 2.5 | 24.2 | 1.2 | 70.5 | 58.75 | 1:0.32:0.55 | 1100 | 1270 | 1.15 | 99 |
| Example 10 | 10 | 3.4 | 27.1 | 1.1 | 64.3 | 58.45 | 1:0.38:0.58 | 950 | 1940 | 2.04 | 97 |
| Example 11 | 12 | 1.1 | 25 | 1.3 | 60.0 | 46.2 | 1:0.37:0.47 | 970 | 1260 | 1.3 | 92 |
| Example 12 | 16 | 1.5 | 30 | 1.1 | 77.5 | 70.5 | 1:0.35:0.58 | 910 | 1110 | 1.2 | 80 |
| Example 13 | 13 | 2.5 | 24 | 1.5 | 84.5 | 56.3 | 1:0.34:0.48 | 940 | 1370 | 1.5 | 91 |
| Example 14 | 14 | 0.9 | 27 | 1.2 | 88.3 | 73.6 | 1:0.43:0.61 | 1320 | 2550 | 1.9 | 110 |
| Example 15 | 15 | 1.0 | 44 | 0.91 | 76 | 83.5 | 1:0.38:0.65 | 2310 | 6700 | 2.9 | 122 |
| Example 16 | 11 | 1.8 | 26 | 1.4 | 93.4 | 66.7 | 1:0.33:0.43 | 890 | 2230 | 2.5 | 83 |
| Comparative Example 4 | Comparative Binder Resin 4 | 0.5 | 49 | 0.265 | 71.2 | 269 | 1:0.42:1.1 | 1100 | 1270 | 1.15 | 99 |
| Comparative Example 5 | Comparative Binder Resin 5 | 2.0 | 16 | 1.0 | 18.5 | 18.5 | 1:0.26:0.44 | 2460 | 5430 | 2.2 | 135 |
| Comparative Example 6 | Comparative Binder Resin 6 | 0 | 2.3 | 1.9 | — | — | — | 1080 | 1750 | 1.6 | 104 |

TABLE 6

Result Estimation of Developers of the Present Invention and Comparative Examples

| Examples and Comp. Examples | Fixability % | Anti-offset Property | Image (Deterioration) | Melt-adhesion and Filming |
|---|---|---|---|---|
| Example 9 | 5.4 | Good | Good | None |
| Example 10 | 6.2 | Good | Good | None |
| Example 11 | 5.8 | Good | Good | None |
| Example 12 | 5.4 | Good | Good | None |
| Example 13 | 8.0 | Good | Good | None |
| Example 14 | 8.1 | Good | Good | None |
| Example 15 | 4.5 | Good | Good | None |
| Example 16 | 5.0 | Good | Good | None |
| Comparative Example 4 | 1.8 | Smear on Reverse | Fogging | Occurred on Developer-carrying Member |
| Comparative Example 5 | 2.5 | Smear on Reverse | Fogging | Occurred on Developer-carrying Member |
| Comparative Example 6 | 3.0 | Smear on Reverse | Fogging | Occurred on Developer-carrying Member & Photosensitive Member (Latent Image Holding Member) |

TABLE 13

Synthesis of Polymer A

| Polymer Synthesis Example | Polymer | Monomer Composition | | Solvent | Polymerization Initiator | Weight Average Molecular Weight | Peak Molecular Weight |
|---|---|---|---|---|---|---|---|
| 21 | A-11 | Styrene<br>Butyl acrylate | 87 part<br>13 part | Xylene | Benzoyl peroxide | 30000 | 28000 |
| 22 | A-12 | Styrene<br>Propyl acrylate | 80 part<br>20 part | Toluene | Benzoyl peroxide | 33000 | 30000 |
| 23 | A-13 | Styrene<br>Methyl acrylate | 90 part<br>10 part | Xylene | Di-t-butyl peroxide | 25000 | 20000 |
| 24 | A-14 | Styrene<br>2-ethylhexyl acrylate | 75 part<br>25 part | Toluene | Azobisiso-butyro-nitrile | 44000 | 40000 |
| 25 | A-15 | Styrene<br>Butyl acrylate<br>Methyl methacrylate | 75 part<br>20 part<br>5 part | Xylene | Benzoyl peroxide | 30000 | 27000 |

TABLE 14

Synthesis of Polymer B

| Polymer Synthesis Example | Polymer | Monomer Composition | | Polymerization Initiator | Weight Average Molecular eight | Peak Molecular Weight |
|---|---|---|---|---|---|---|
| 26 | B-11 | Styrene<br>Butyl acrylate | 80 part<br>20 part | 1,1-bis(t-butylperoxy) cyclohexane | 703000 | 625000 |
| 27 | B-12 | Styrene<br>Butyl acrylate | 83 part<br>17 part | 1,3-bis(t-butylperoxy-isopropyl)benzene | 595000 | 508000 |
| 28 | B-13 | Styrene<br>Methyl methacrylate<br>Butyl acrylate | 80 part<br>4 part<br>16 part | 1,3-bis(t-butylperoxy-isopropyl)benzene | 454000 | 403000 |
| 29 | B-14 | Styrene<br>2-ethylhexyl acrylate | 75 part<br>25 part | 1,1-bis(t-butylperoxy) cyclohexane | 853000 | 798000 |
| 30 | B-15 | Styrene<br>Butyl acrylate<br>Divinyl benzene | 77 part<br>23 part<br>0.02 part | 1,3-bis(t-butylperoxy-isopropyl)benzene | 700000 | 657000 |

TABLE 15

Synthesis of Polymer A

| Comparative Polymer Synthesis Example | Comp. Polymer | Monomer Composition | | Solvent | Polymerization Initiator | Weight Average Molecular Weight | Peak Molecular Weight |
|---|---|---|---|---|---|---|---|
| 5 | Comp. polymer A-3 | Styrene<br>Butyl acrylate | 85 part<br>15 part | Toluene | Azo bis iso-butyro-nitrile | 56000 | 52000 |

TABLE 16

Production of Binder Resins and Comparative Binder Resins

| Production Example | Polymer A | | Polymer B | |
|---|---|---|---|---|
| Binder Resin 17 | A-11 | 70 part | B-11 | 30 part |
| Binder Resin 18 | A-13 | 66 part | B-12 | 34 part |
| Binder Resin 19 | A-12 | 72 part | B-13 | 28 part |
| Binder Resin 20 | A-14 | 55 part | B-15 | 45 part |
| Binder Resin 21 | A-15 | 68 part | B-14 | 32 part |
| Binder Resin 22 | A-11 | 60 part | B-12 | 40 part |
| Binder Resin 23 | A-12 | 65 part | B-11 | 35 part |

TABLE 16-continued

Production of Binder Resins and Comparative Binder Resins

| Production Example | Polymer A | | Polymer B | |
|---|---|---|---|---|
| Binder Resin 24 | A-15 | 70 part | B-15 | 30 part |
| Comparative Binder Resin 7 | Comp. A-3 | 80 part | B-11 | 20 part |
| Comparative Binder Resin 8 | A-14 | 85 part | Comp. B-13 | 15 part |
| Comparative Binder Resin 9 | A-12 | 100 part | | 0 part |

TABLE 17

Examples and Comparative Examples

| Exp. & Comp. Exp. | Binder Resin | THF Insoluble weight % | Mw/Mn | MA × $10^4$ | MB × $10^4$ | MB/MA | SA:SB:Sd | Releasing Agent Mn | MW | Mn/Mw | m.p. (°C.) |
|---|---|---|---|---|---|---|---|---|---|---|---|
| Example 17 | 17 | 1.9 | 17.5 | 2.9 | 61.9 | 21.3 | 1:0.35:0.30 | 2200 | 6300 | 2.9 | 148 |
| Example 18 | 18 | 3.2 | 16.3 | 2.0 | 49.9 | 24.95 | 1:0.30:0.29 | 1200 | 2500 | 2.1 | 103 |
| Example 19 | 19 | 1.3 | 13.2 | 2.9 | 40.0 | 13.8 | 1:0.29:0.23 | 1500 | 3400 | 2.3 | 116 |
| Example 20 | 20 | 1.5 | 14.0 | 3.7 | 63.9 | 17.3 | 1:0.38:0.29 | 2200 | 6300 | 2.9 | 148 |
| Example 21 | 21 | 2.0 | 19.3 | 2.5 | 72.0 | 28.8 | 1:0.34:0.32 | 1200 | 2500 | 2.1 | 103 |
| Example 22 | 22 | 2.5 | 13.9 | 2.8 | 49.8 | 17.8 | 1:0.37:0.30 | 1500 | 3400 | 2.3 | 116 |
| Example 23 | 23 | 1.8 | 14.7 | 2.9 | 61.7 | 21.3 | 1:0.39:0.29 | 1500 | 3400 | 2.3 | 116 |
| Example 24 | 24 | 3.2 | 15.1 | 2.5 | 64.0 | 25.6 | 1:0.33:0.31 | 1200 | 2500 | 2.1 | 103 |
| Comparative | Comparative | 2.2 | 14.5 | 5.1 | 61.2 | 12.0 | 1:0.21:0.18 | 1300 | 2700 | 2.1 | 105 |

TABLE 17-continued

| Exp. & Comp. Exp. | Binder Resin | THF Insoluble weight % | Examples and Comparative Examples Mw/Mn | MA × $10^4$ | MB × $10^4$ | MB/MA | SA:SB:Sd | Releasing Agent Mn | MW | Mn/Mw | m.p. (°C.) |
|---|---|---|---|---|---|---|---|---|---|---|---|
| Example 7 | Binder Resin 7 | | | | | | | | | | |
| Comparative Example 8 | Comparative Binder Resin 8 | 2.0 | 11.8 | 3.8 | 39.8 | 10.5 | 1:0.18:0.15 | 1200 | 2500 | 2.1 | 103 |
| Comparative Example 9 | Comparative Binder Resin 9 | 0 | 2.6 | 3.0 | — | — | — | 1200 | 2500 | 2.1 | 103 |

TABLE 18

| Examples and Comp. Examples | Result Estimation of developers of the Present Invention and Comparative Examples: Fixability % | Anti-offset Property | Image (Deterioration) | Melt-adhesion and Filming |
|---|---|---|---|---|
| Example 17 | 7.5 | Good | Good | None |
| Example 18 | 6.5 | Good | Good | None |
| Example 19 | 5.5 | Good | Good | None |
| Example 20 | 9.6 | Good | Good | None |
| Example 21 | 8.0 | Good | Good | None |
| Example 22 | 7.8 | Good | Good | None |
| Example 23 | 8.3 | Good | Good | None |
| Example 24 | 5.0 | Good | Good | None |
| Comparative Example 7 | 18.8 | Good | Good | None |
| Comparative Example 8 | 8.0 | Offset at High Temp. | Fogging | None |
| Comparative Example 9 | 2.0 | Offset at High Temp. Smear on Reverse | Fogging | Occurred on Developer-carrying Member & Photosensitive Member |
| Comparative Example 10 | 8.0 | High Temp. Offset | Fogging | Occurred on Developer-carrying Member & Photosensitive Member |

TABLE 19

| Polymer Synthesis Example | Polymer | Synthesis of Polymer A: Monomer Composition | | Solvent | Polymerization Initiator | Weight Average Molecular Weight | Peak Molecular Weight |
|---|---|---|---|---|---|---|---|
| 31 | A-16 | Styrene<br>Butyl acrylate | 85 part<br>15 part | Xylene | Di-t-butyl peroxide | 14000 | 12000 |
| 32 | A-17 | Styrene<br>Butyl acrylate | 80 part<br>20 part | Xylene | Benzoyl peroxide | 11500 | 10200 |
| 33 | A-18 | Styrene<br>Methyl methacrylate | 75 part<br>25 part | Xylene | Benzoyl peroxide | 15000 | 13700 |
| 34 | A-19 | Styrene<br>2-ethylhexyl acrylate | 82 part<br>18 part | Toluene | Benzoyl peroxide | 14000 | 12900 |
| 35 | A-20 | Styrene<br>Butyl acrylate<br>Methyl methacrylate | 80 part<br>15 part<br>5 part | Xylene | Benzoyl peroxide | 19000 | 18500 |

TABLE 20

| Polymer Synthesis Example | Polymer | Synthesis of Polymer B: Monomer Composition | | Polymerization Initiator | Weight Average Molecular eight | Peak Molecular Weight |
|---|---|---|---|---|---|---|
| 36 | B-16 | Styrene<br>Butyl acrylate | 78 part<br>22 part | Benzoyl peroxide | 915000 | 723000 |
| 37 | B-17 | Styrene<br>Butyl acrylate | 83 part<br>17 part | Benzoyl peroxide | 615000 | 591000 |
| 38 | B-18 | Styrene<br>Butyl acrylate<br>Methyl methacrylate | 85 part<br>8 part<br>7 part | Benzoyl peroxide | 817000 | 798000 |
| 39 | B-19 | Styrene<br>2-ethylhexyl acrylate | 77 part<br>23 part | 1,1'-azobis(cyclohexane-1-carbonitrile) | 96200 | 933000 |
| 40 | B-20 | Styrene<br>Butyl acrylate | 80 part<br>20 part | Benzoyl peroxide | 745000 | 680000 |

TABLE 20-continued

| Synthesis of Polymer B | | | | | | |
|---|---|---|---|---|---|---|
| Polymer Synthesis Example | Polymer | Monomer Composition | | Polymerization Initiator | Weight Average Molecular eight | Peak Molecular Weight |
| | | Divinyl benzene | 0.02 part | | | |

TABLE 21

| Synthesis of Comparative Polymers A and B | | | | | | | |
|---|---|---|---|---|---|---|---|
| Comparative Polymer Synthesis Example | Comp. Polymer | Monomer Composition | | Solvent | Polymerization Initiator | Weight Average Molecular Weight | Peak Molecular Weight |
| 6 | comp. A-4 | Styrene<br>Butyl acrylate | 94 part<br>6 part | Xylene | Di-t-butyl peroxide | 3500 | 3300 |
| 7 | Comp. B-3 | Styrene<br>Butyl acrylate<br>Divinyl benzene | 80 part<br>20 part<br>0.2 part | — | Benzoyl peroxide | 203000 | 189000 |

TABLE 22

| Production of Binder Resins and Comparative Binder Resins | | | | |
|---|---|---|---|---|
| Production Example | Polymer A | | Polymer B | |
| Binder Resin 25 | A-16 | 70 part | B-16 | 30 part |
| Binder Resin 26 | A-17 | 66 part | B-20 | 34 part |
| Binder Resin 27 | A-18 | 72 part | B-19 | 28 part |
| Binder Resin 28 | A-19 | 55 part | B-18 | 45 part |
| Binder Resin 29 | A-20 | 68 part | B-19 | 32 part |
| Binder Resin 30 | A-19 | 60 part | B-19 | 40 part |
| Binder Resin 31 | A-17 | 65 part | B-18 | 35 part |

TABLE 22-continued

| Production of Binder Resins and Comparative Binder Resins | | | | |
|---|---|---|---|---|
| Production Example | Polymer A | | Polymer B | |
| Binder Resin 32 | A-18 | 70 part | B-18 | 30 part |
| Comparative Binder Resin 10 | Comp. A-4 | 80 part | B-16 | 20 part |
| Comparative Binder Resin 11 | A-16 | 70 part | Comp. B-3 | 30 part |
| Comparative Binder Resin 12 | A-20 | 100 part | | 0 part |

TABLE 23

| Examples and Comparative Examples | | | | | | | | | | | |
|---|---|---|---|---|---|---|---|---|---|---|---|
| Exp. & Comp. Exp. | Binder Resin | THF Insoluble weight % | Mw/Mn | MA × $10^4$ | MB × $10^4$ | MB/MA | SA:SB:Sd | Releasing Agent Mn | MW | Mn/Mw | m.p. (°C.) |
| Example 25 | 25 | 2.3 | 23.8 | 1.3 | 71.8 | 55.2 | 1:0.34:0.49 | 600 | 930 | 1.55 | 98 |
| Example 26 | 26 | 3.8 | 25.3 | 1.1 | 67.5 | 61.4 | 1:0.43:0.61 | 650 | 1450 | 2.2 | 103 |
| Example 27 | 28 | 1.3 | 31 | 1.3 | 78 | 60 | 1:0.43:0.59 | 550 | 810 | 1.5 | 89 |
| Example 28 | 32 | 1.5 | 35 | 1.4 | 77.5 | 55 | 1:0.37:0.56 | 500 | 750 | 1.5 | 78 |
| Example 29 | 29 | 2.0 | 25 | 1.5 | 90.2 | 60 | 1:0.41:0.65 | 530 | 980 | 1.8 | 95 |
| Example 30 | 30 | 0.5 | 29 | 1.3 | 92.5 | 71 | 1:0.43:0.54 | 680 | 1300 | 1.9 | 102 |
| Example 31 | 31 | 1.0 | 46 | 0.86 | 77.5 | 90.1 | 1:0.38:0.55 | 1200 | 3480 | 2.9 | 120 |
| Example 32 | 27 | 1.5 | 26 | 1.4 | 91.2 | 65 | 1:0.33:0.60 | 500 | 1200 | 2.4 | 99 |
| Comparative Example 11 | Comparative Binder Resin 10 | 1.0 | 28 | 0.28 | 71.8 × $10^{-4}$ | 256 | 1:0.4:1.05 | 600 | 930 | 1.55 | 98 |
| Comparative Example 12 | Comparative Binder Resin 11 | 2.0 | 16 | 1.2 | 17.9 | 15 | 1:0.26:0.47 | 1300 | 4900 | 3.8 | 135 |
| Comparative Example 13 | Comparative Binder Resin 12 | 0 | 2.1 | 1.9 | — | — | — | 560 | 1150 | 2.1 | 109 |

TABLE 24

| Result Estimation of Developers of the Present Invention and Comparative Examples | | | | |
|---|---|---|---|---|
| Examples and Comp. Examples | Fixability % | Anti-offset Property | Image (Deterioration) | Melt-adhesion and Filming |
| Example 25 | 6.0 | Good | Good | None |
| Example 26 | 6.5 | Good | Good | None |
| Example 27 | 5.5 | Good | Good | None |
| Example 28 | 6.0 | Good | Good | None |
| Example 29 | 8.0 | Good | Good | None |
| Example 30 | 7.5 | Good | Good | None |
| Example 31 | 4.5 | Good | Good | None |
| Example 32 | 5.0 | Good | Good | None |
| Comparative Example 11 | 1.9 | Smear on Reverse | Fogging | Occurred on Developer-carrying Member |
| Comparative Example 12 | 3.0 | Smear on Reverse | Fogging | Occurred on Developer-carrying Member |
| Comparative Example 13 | 2.0 | Smear on Reverse | Fogging | Occurred on Developer-carrying Member & |

TABLE 24-continued

| Examples and Comp. Examples | Result Estimation of Developers of the Present Invention and Comparative Examples | | | |
|---|---|---|---|---|
| | Fixability % | Anti-offset Property | Image (Deterioration) | Melt-adhesion and Filming |
| | | | | Photosensitive Member |

TABLE 25

Synthesis of Polymer A

| Polymer Synthesis Example | Polymer | Monomer Composition | | Solvent | Polymerization Initiator | Mw | Mw/Mn | Flow-beginning Point (°C.) | Softening Point | Tg | Peak Molecular Weight |
|---|---|---|---|---|---|---|---|---|---|---|---|
| 41 | A-21 | Styrene<br>Butyl acrylate | 82 part<br>18 part | Xylene | Di-t-butyl peroxide | 12000 | 2.6 | 86 | 108 | 54 | 11500 |
| 42 | A-22 | Styrene<br>Butyl acrylate | 85 part<br>15 part | Xylene | Benzoyl peroxide | 11000 | 2.4 | 85 | 105 | 61 | 10200 |
| 43 | A-23 | Styrene<br>Butyl acrylate | 80 part<br>20 part | Xylene | Di-t-butyl peroxide | 12500 | 2.2 | 86 | 101 | 53 | 11800 |
| 44 | A-24 | Styrene<br>2-ethylhexyl acrylate | 80 part<br>20 part | Xylene | Azobisiso-butylnitrile | 11000 | 2.3 | 86 | 102 | 51 | 10500 |
| 45 | A-25 | Styrene<br>Butyl acrylate<br>Butyl methacrylate | 88 part<br>6 part<br>6 part | Xylene | Benzoyl peroxide | 14000 | 2.2 | 87 | 110 | 70 | 13300 |
| 46 | A-26 | Styrene<br>Butyl methacrylate | 89 part<br>11 part | Xylene | Benzoyl peroxide | 5000 | 1.9 | 79 | 96 | 50 | 4900 |

TABLE 26

Synthesis of Polymer B

| Polymer Synthesis Example | Polymer | Monomer Composition | | Polymerization Initiator | MW × $10^4$ | Mw/Mn | Flow-beginning Point (°C.) | Softening Point | Tg (°C.) | Peak Molecular Weight |
|---|---|---|---|---|---|---|---|---|---|---|
| 47 | B-21 | Styrene<br>Butyl acrylate | 80 part<br>20 part | Benzoyl peroxide | 58 | 2.7 | 120 | 170 | 61.8 | 57.0 |
| 48 | B-22 | Styrene<br>Butyl acrylate | 82 part<br>18 part | Benzoyl peroxide | 70 | 2.6 | 127 | 180 | 67.0 | 66.3 |
| 49 | B-23 | Styrene<br>Methyl acrylate | 85 part<br>15 part | Benzoyl peroxide | 95 | 2.5 | 131 | 184 | 69.0 | 68.1 |
| 50 | B-24 | Styrene<br>2-ethylhexyl acrylate | 80 part<br>20 part | 1,1-bis(t-butylperoxy) 3,3,5-trimethyl cyclohexanone | 73 | 2.3 | 127 | 180 | 67.0 | 65.9 |
| 51 | B-25 | Styrene<br>Butyl acrylate<br>Methyl methacrylate | 80 part<br>10 part<br>10 part | Benzoyl peroxide | 64 | 2.4 | 122 | 173 | 65.5 | 64.2 |
| 52 | B-26 | Styrene<br>Butyl acrylate | 77 part<br>23 part | Benzoyl peroxide | 60 | 2.3 | 117 | 165 | 58.0 | 58.8 |

TABLE 27

Synthesis of Comparative Polymers A and B

| Comparative Polymer Synthesis Example | Comp. Polymer | Monomer Composition | | Solvent | Polymerization Initiator | Mw | Mw/Mn | Flow-beginning Point (°C.) | Softening Point | Tg (°C.) | Peak Molecular Weight |
|---|---|---|---|---|---|---|---|---|---|---|---|
| 8 | comp. A-5 | Styrene<br>Butyl acrylate | 95 part<br>5 part | Xylene | Di-t-butyl peroxide | 4000 | 4.0 | 72 | 93 | 52 | 3900 |
| 9 | Comp. B-4 | Styrene<br>Butyl acrylate<br>Divinyl benzene | 86 part<br>14 part<br>0.3 part | — | Benzoyl peroxide | 205000 | 3.5 | 105 | 148 | 53 | 198000 |

TABLE 28

Production of Binder Resins and Comparative Binder Resins

| Production Example | Polymer A | | Polymer B | |
|---|---|---|---|---|
| Binder Resin 33 | A-21 | 70 part | B-21 | 30 part |
| Binder Resin 34 | A-22 | 75 part | B-24 | 25 part |
| Binder Resin 35 | A-23 | 70 part | B-22 | 30 part |
| Binder Resin 36 | A-24 | 50 part | B-23 | 50 part |
| Binder Resin 37 | A-25 | 80 part | B-25 | 20 part |
| Binder Resin 38 | A-24 | 60 part | B-24 | 40 part |
| Binder Resin 39 | A-23 | 65 part | B-25 | 35 part |
| Binder Resin 40 | A-22 | 55 part | B-22 | 45 part |
| Binder Resin 41 | A-26 | 70 part | B-26 | 30 part |
| Comparative Binder Resin 13 | Comp. A-5 | 70 part | B-21 | 30 part |
| Comparative Binder Resin 14 | A-21 | 80 part | Comp. B-4 | 20 part |
| Comparative Binder Resin 15 | A-24 | 100 part | | 0 part |

What is claimed is:

1. An image forming process comprising: a step of feeding a developer from a feeding roller onto a developer-carrying member, a step of applying the developer onto the developer-carrying member in a predetermined layer-thickness by pressing the developer against the developer-carrying member with a blade and simultaneously giving an electrostatic charge to the developer by friction, a step of forming a developed image by developing an electrostatic image formed on a latent image holding member with the developer applied on the developer-carrying member, a step of transferring the developed image onto a recording medium, and a step of fixing the transferred developed image on the recording medium by action of heat and pressure:

wherein said developer is a non-magnetic one-component type developer comprising non-magnetic toner, the non-magnetic toner containing at least a

TABLE 29

Examples and Comparative Examples

| Exp. & Comp. Exp. | Binder Resin | THF Insoluble weight % | Mw/Mn | MA × $10^4$ | MB × $10^4$ | MB/MA | SA:SB:Sd | Releasing Agent Mn | MW | Mn/Mw | m.p. (°C.) |
|---|---|---|---|---|---|---|---|---|---|---|---|
| Example 33 | 33 | 1.2 | 26 | 1.1 | 56.5 | 51.4 | 1:0.35:0.55 | 1050 | 2500 | 2.4 | 108 |
| Example 34 | 34 | 1.5 | 31 | 1.0 | 65.0 | 65 | 1:0.39:0.58 | 850 | 1380 | 1.6 | 102 |
| Example 35 | 37 | 2.0 | 26 | 1.2 | 64.0 | 53 | 1:0.23:0.60 | 550 | 980 | 1.8 | 96 |
| Example 36 | 38 | 1.7 | 33 | 1.0 | 64.5 | 64.5 | 1:0.36:0.54 | 550 | 850 | 1.5 | 89 |
| Example 37 | 39 | 2.2 | 28 | 1.05 | 63.3 | 60.3 | 1:0.34:0.51 | 1200 | 3500 | 2.9 | 120 |
| Example 38 | 40 | 1.8 | 27 | 0.98 | 65.5 | 66.8 | 1:0.41:0.63 | 520 | 770 | 1.5 | 80 |
| Example 39 | 35 | 1.6 | 32 | 1.08 | 65.4 | 60.6 | 1:0.36:0.51 | 500 | 1200 | 2.4 | 99 |
| Example 40 | 36 | 2.5 | 27 | 0.99 | 67.6 | 68.3 | 1:0.44:0.62 | 550 | 810 | 1.5 | 90 |
| Example 41 | 41 | 1.9 | 30 | 0.49 | 58.0 | 118 | 1:0.33:0.66 | 600 | 1090 | 1.8 | 94 |
| Comparative Example 14 | Comparative Binder Resin 13 | 1.3 | 39 | 0.38 | 56.5 | 149 | 1:0.44:0.60 | 1080 | 2200 | 2.0 | 96 |
| Comparative Example 15 | Comparative Binder Resin 14 | 2.8 | 13 | 1.12 | 18.9 | 16.9 | 1:0.19:0.21 | 1300 | 4900 | 3.8 | 135 |
| Comparative Example 16 | Comparative Binder Resin 15 | 0.2 | 2.3 | 1.05 | — | — | — | 560 | 1150 | 2.1 | 109 |

TABLE 30

Result Estimation of Developers of Invention with Comparison

| Example & Comp. Example | Binder Resin | Fixation Starting Temp. (°C.) | Anti-Offset Temp. Range (°C.) | Anti-blocking (50° C. 3 days) | Develop-ability | Melt-adhesion and Filming |
|---|---|---|---|---|---|---|
| Example 33 | 33 | 120 | 115–225 | 0 | 0 | None |
| Example 34 | 34 | 125 | 120–225 | 0 | 0 | None |
| Example 35 | 37 | 120 | 115–220 | 0 | 0 | None |
| Example 36 | 38 | 130 | 120–225 | 0 | 0 | None |
| Example 37 | 39 | 135 | 125–225 | 0 | 0 | None |
| Example 38 | 40 | 135 | 125–230 | 0 | 0 | None |
| Example 39 | 35 | 120 | 110–215 | 0 | 0 | None |
| Example 40 | 36 | 140 | 125–235 | 0 | 0 | None |
| Example 41 | 41 | 115 | 115–220 | 0 | 0 | None |
| Comp. Example 14 | Comp. Binder Resin 13 | 115 | 115–215 | X | ΔX | Occurred |
| Comp. Example 15 | Comp. Binder Resin 14 | 110 | 110–150 | Δ | Δ | None |
| Comp. Example 16 | Comp. Binder Resin 15 | 105 | 105–145 | ΔX | ΔX | Occurred |

binder resin and a releasing agent; the binder resin having a THF-soluble portion and less than 10% by weight of a THF-insoluble portion based on the binder resin, the THF-soluble portion having a molecular weight distribution curve pattern wherein a ratio of weight-average molecular weight/number-average molecular weight (Mw/Mn) is not less than 8, and at least one peak in the range of molecular weight of from $3.0\times10^3$ to $4.5\times10^4$(MA), at least one peak in the range of molecular weight of from $3.8\times10^5$ to $1.0\times10^6$(MB), and a local minimum point in the range of molecular weight of from $2.0\times10^4$ to $3.8\times10^5$(Md) are present, and peak molecular weight ratio MB/MA is from 10 to 150, and the ratio of SA:SB:Sd is 1:(0.2–0.7):(0.2–0.8) where SA is the area under the molecular weight distribution curve at the molecular weight range of 400 to Md, SB is the area under the molecular weight distribution curve at the molecular weight range of Md to $5.0\times10^6$, and Sd is the area surrounded by the molecular weight distribution curve and the straight line drawn from the peaktop at MA to the peaktop at MB;

the releasing agent having a number-average molecular weight of not higher than $3.0\times10^3$, a weight average molecular weight of not higher than $1.2\times10^4$, and a ratio of weight-average molecular weight/number average molecular weight of not more than 4, and a melting point of from 60° to 150° C., and being contained in the non-magnetic toner in an amount of from 0.1 to 20% by weight based on the binder resin

2. The process according claim 1, wherein the THF-soluble portion of the binder resin has a molecular weight distribution curve pattern determined by GPC in which a ratio of weight-average molecular weight-/number-average molecular weight (Mw/Mn) is not less than 18, and at least one peak in the range of molecular weight of from $3.0\times10^3$ to $2\times10^4$(MA), at least one peak in the range of molecular weight of from $3.8\times10^5$ to $1.0\times10^6$(MB), and a local minimum point in the range of molecular weight of from $2.0\times10^4$ to $3.8\times10^5$(Md) are present, and peak molecular weight ratio MB/MA being from 30 to 150, and the ratio of SA:SB:Sd is 1:(0.25–0.7):(0.3–0.8);

the binder resin is produced by dissolving and mixing a polymer A having a weight-average molecular weight of from $5.0\times10^3$ to $3.0\times10^4$ and a polymer B having a weight-average molecular weight of from $4.0\times10^5$ to $1.5\times10^6$ in a solvent which is capable of dissolving both of the polymer A and the polymer B and subsequently removing the solvent, and the releasing agent has a number-average molecular weight (Mn) of not higher than $1.0\times10^3$, a weight-average molecular weight (Mw) of not higher than $1.2\times10^4$, a ratio of weight-average molecular weight to number-average molecular weight (Mw/Mn) of not more than 4.0, and a melting point in the range of from 60° to 150° C., and the releasing agent is contained in the non-magnetic toner in an amount of from 0.1 to 20% by weight based on the binder resin.

3. The process according claim 1, wherein the THF-soluble portion of the binder resin has a molecular weight distribution curve pattern determined by GPC in which a ratio of weight-average molecular weight-/number-average molecular weight (Mw/Mn) is not less than 18, and at least one peak in the range of molecular weight of from $3.0\times10^3$ to $2\times10^4$(MA), at least one peak in the range of molecular weight of from $3.8\times10^5$ to $1.0\times10^6$(MB), and a local minimum point in the range of molecular weight of from $2.0\times10^4$ to $3.8\times10^5$(Md) are present, and peak molecular weight ratio MB/MA is from 30 to 150, and the ratio of SA:SB:Sd is 1:(0.25–0.7):(0.3–0.8);

the binder resin is produced by dissolving and mixing a polymer A having a weight-average molecular weight of from $5.0\times10^3$ to $3.0\times10^4$ and a polymer B having a weight-average molecular weight of from $4.0\times10^5$ to $1.5\times10^6$ in a solvent which is capable of dissolving both of the polymer A and the polymer B and subsequently removing the solvent, and the releasing agent has a number-average molecular weight (Mn) of not higher than $1.0\times10^3$, a weight-average molecular weight (Mw) of not higher than $2.5\times10^3$, a ratio of weight-average molecular weight to number-average molecular weight (Mw/Mn) of not more than 4.0, and a melting point in the range of from 60° to 150° C., and the releasing agent is contained in the non-magnetic toner in an amount of from 0.1 to 20% by weight based on the binder resin.

4. The process according claim 1, wherein the THF-soluble portion of the binder resin has a molecular weight distribution curve pattern determined by GPC in which a ratio of weight-average molecular weight-/number-average molecular weight (Mw/Mn) is not less than 8, and at least one peak in the range of molecular weight of from $1.5\times10^4$ to $4.0\times10^4$(MA), at least one peak in the range of molecular weight of from $3.8\times10^5$ to $1.0\times10^6$(MB), and a local minimum point in the range of molecular weight of from $4.0\times10^4$ to $3.8\times10^5$(Md) are present, and peak molecular weight ratio MB/MA is from 10 to 70, and the ratio of SA:SB:Sd is 1:(0.2–0.5):(0.2–0.5);

the binder resin is produced by dissolving and mixing a polymer A having a weight-average molecular weight of from $2.0\times10^4$ to $6.0\times10^4$ and a polymer B having a weight-average molecular weight of from $4.0\times10^5$ to $1.5\times10^6$ in a solvent which is capable of dissolving both of the polymer A and the polymer B and subsequently removing the solvent, and the releasing agent has a number-average molecular weight (Mn) of not higher than $3.0\times10^3$, a weight-average molecular weight (Mw) of not higher than $1.2\times10^4$, a ratio of weight-average molecular weight to number-average molecular weight (Mw/Mn) of not mope than 4.0, and a melting point in the range of from 60° to 150° C., and the releasing agent is contained in the non-magnetic toner in an amount of from 0.1 to 20% by weight based on the binder resin.

5. The process according claim 1, wherein the THF-soluble portion of the binder resin has a molecular weight distribution curve pattern determined by GPC in which a ratio of weight-average molecular weight-/number-average molecular weight (Mw/Mn) is not less than 18, and at least one peak in the range of molecular weight of from $3.0\times10^3$ to $2.0\times10^4$(MA), at least one peak in the range of molecular weight of from $3.8\times10^5$ to $1.0\times10^6$(MB), and a local minimum point in the range of molecular weight of from $2.0\times10^4$ to $3.8\times10^5$(Md) are present, and peak molecular weight ratio MB/MA being from 30 to 150, and the ratio of SA:SB:Sd is 1:(0.25–0.7):(0.3–0.8);

the binder resin is produced by dissolving and mixing a polymer A having a weight-average molecular weight of from $5.0\times10^3$ to $3.0\times10^4$ and a polymer B having a weight-average molecular weight of from $4.0\times10^5$ to $1.5\times10^6$ in a solvent which is capable of dissolving both of the polymer A and the polymer B and subsequently removing the solvent, and the releasing agent has a number-average molecular weight (Mn) of not higher than $3.0\times10^3$, a weight-average molecular weight (Mw) of not higher than $7.5\times10^3$, a ratio of weight-average molecular weight to number-average molecular weight (Mw/Mn) of not more than 4.0, and a melting point in the range of from 60° to 140° C., and the releasing agent is contained in the non-magnetic toner in an amount of from 0.1 to 20% by weight based on the binder resin.

6. The process according to claim 1, wherein the binder resin is produced by dissolving and mixing a polymer A having a weight-average molecular weight (Mw) of from $5.0\times10^3$ to $4.0\times10^4$ and a polymer B having a weight average-molecular weight (Mw) of from $4.0\times10^5$ to $1.5\times10^6$ in a solvent capable of dissolving both of the polymer A and the polymer B, and, removing the solvent.

7. The process according to claim 1, wherein the binder resin is produced by dissolving and mixing a polymer A having a weight-average molecular weight (Mw) of from $7.0\times10^3$ to $2.5\times10^4$ and a polymer B having a weight average-molecular weight (Mw) of from $4.5\times10^5$ to $1.0\times10^6$ in a solvent capable of dissolving both of the polymer A and the polymer B, and, removing the solvent.

8. The process according to claim 7, wherein the polymer A is prepared by solution polymerization and the polymer B is prepared by suspension polymerization.

9. The process according to claim 1, wherein the binder resin has a THF-insoluble portion in an amount of 5% or less by weight of the binder resin.

10. The process according to claim 1, wherein the binder resin has a ratio of weight-average molecular weight to number-average molecular weight (Mw/Mn) of not less than 12 according to GPC molecular weight distribution measurement.

11. The process according to claim 1, wherein the binder resin has a ratio of weight-average molecular weight to number-average molecular weight (Mw/Mn) of from 25 to 60 according to GPC molecular weight distribution measurement.

12. The process according to claim 1, wherein the binder resin has the peak molecular weight MA in the region of molecular weight of from $5.0\times10^3$ to $3.0\times1O^4$, the peak molecular weight MB in the region of molecular weight from $4.5\times10^5$ to $9.0\times10^5$, the local minimum point in the region of from $5.5\times10^4$ to $2.5\times10^5$, and the ratio of MA/MB of from 15 to 120.

13. The process according to claim 1, wherein the binder resin has the ratio of the areas SA:SB:Sd in the range of 1:(0.25–0.55):(0.2–0.7) according to molecular weight distribution curve.

14. The process according to claim 1, wherein the binder resin has the ratio of the areas SA:SB:Sd in the range of 1:(0.3–0.45):(0.3–0.7) according to molecular weight distribution curve.

15. The process according to claim 1, wherein the releasing agent has the number-average molecular weight (Mn) of not higher than $1.0\times10^3$, the ratio of weight-average molecular weight to number-average molecular weight (Mw/Mn) of not mope than 4.0, and the melting point of from 60° to 150° C., and the releasing agent is contained in the non-magnetic toner in an amount of from 0.1 to 20% by weight based on the binder resin.

16. The process according to claim 1, wherein the binder resin comprises a styrene-acrylic type copolymer.

17. The process according to claim 16, wherein the styrene-acrylic type copolymer comprises a copolymer of styrene with acrylic acid or a derivative thereof.

18. The process according to claim 16, wherein the styrene-acrylic type copolymer comprises a copolymer of styrene with methacrylic acid or a derivative thereof.

19. The process according to claim 1, wherein the releasing agent comprises one or more substances selected from the group consisting of paraffin wax, low molecular weight polyethylene wax, low molecular weight ethylene-propylene copolymer, low molecular weight polypropylene wax, and polyolefin waxes modified by grafting with an aromatic vinyl monomer, an unsaturated aliphatic acid, or unsaturated aliphatic acid ester.

20. The process according to claim 19, wherein the releasing agent comprises a graft-modified polyolefin wax.

21. The process according to claim 1, wherein the non-magnetic toner contains one or more additives selected from the group consisting of lubricants, abradants, fluidity-imparting agents, caking-inhibitors, electroconductivity-imparting agents, fixation aids, and developability-improving agents.

22. The process according to claim 1, wherein the binder resin comprises a low-temperature softening resin of styrene-acrylic type prepared by solution polymerization and a high-temperature softening resin of styrene-acrylic type prepared by suspension polymerization;

the low-temperature softening resin having a weight-average molecular weight (Mw) of from $5.0\times10^3$ to $6.0\times10^4$, the ratio of weight-average molecular weight to number-average molecular weight (Mw/Mn) of not more than 3.5, a flow-beginning temperature in the range of from 75° to 90° C. by Flow Tester, a softening temperature in the range of from 80° to 110° C., and a glass-transition temperature (Tg) in the range of not lower than 40° C., being contained in the non-magnetic toner in an amount of not less than 50% by weight based on the binder resin;

the high-temperature softening resin having a weight-average molecular weight (Mw) of from $4.0\times10^5$ to $1.5\times10^6$, the ratio of weight-average molecular weight to number-average molecular weight (Mw/Mn) of not more than 5.0, a flow-beginning temperature in the range of from 110° to 160° C. by a flow tester, a softening temperature in the range of from 150° to 230° C., and a glass-transition temperature (Tg) in the range of not lower than 40° C.;

the ratio of the low-temperature softening resin to the high-temperature softening resin being in the range of from 50:50 to 90:10 by weight; and the binder resin being prepared by dissolving and mixing the low-temperature softening resin and the high-temperature softening resin in a solvent capable of dissolving the both resins, and removing the solvent.

23. The process according to claim 22, wherein the low-temperature softening resin has a weight-average molecular weight (Mw) in the range of from $7.0\times10^3$ to $2.5\times10^4$, a ratio of weight-average molecular weight to number-average molecular weight (Mw/Mn) of not more 3.0, a flow-beginning temperature in the range of from 80° to 90° C. by Flow Tester, a softening temperature in the range of from 85° to 105° C., and a glass transition temperature (Tg) in the range of from 55° to 70° C.

24. The process according to claim 22, wherein the high-temperature softening resin has a weight-average molecular weight (Mw) in the range of from $4.5\times10^5$ to $1.0\times10^6$, a ratio of weight-average molecular weight to number-average molecular weight (Mw/Mn) of not more than 4.5, a flow-beginning temperature in the range of from 115° to 150° C. by Flow Tester, a softening temperature in the range of from 160° to 210° C., and a glass transition temperature (Tg) in the range of from 50° to 70° C.

25. The process according to claim 22, wherein the high-temperature softening resin has the ratio of weight-average molecular weight to number-average molecular weight (Mw/Mn) of not more than 4.5.

26. The process according to claim 1, wherein the latent image-supporting member is electrostatically charged by contact with a charging means, and an electrostatically charged latent image is formed on the charged image-forming member by a latent image forming means.

27. The process according to claim 1, wherein the feeding roller is made of polyurethane rubber.

28. The process according to claim 1, wherein the developer-applying blade is pressed against the developer-carrying member at a linear pressure in the range of from 3 to 250 g/cm in the direction of the axis of the sleeve to apply the developer onto the developer-carrying member.

29. The process according to claim 1, wherein the developer-applying blade is made of a material selected from the group consisting of silicone rubber, polyurethane, fluororubber, and polychlorobutadiene, and the developer is positively charged by means of developer-applying blade.

30. The process according to claim 1, wherein the developer-applying blade is made of styrene-butadiene rubber or nylon, and the developer is negatively charged by means of the developer-applying blade.

31. The process according to claim 1, wherein the electrostatic latent image formed on the latent image-supporting member is developed with the developer applied on the developer-carrying member under application of an alternate current bias and/or a direct current bias.

32. The process according to claim 1, wherein the latent image supporting member is a photosensitive drum having a photosensitive layer containing an organic photoconductive substance.

33. The process according to claim 22, wherein said binder resin comprises a low-temperature softening resin of styrene-acrylic type prepared by solution polymerization and a high-temperature softening resin of styrene-acrylic type prepared by suspension polymerization;

the low-temperature softening resin having a weight-average molecular weight (Mw) of from $5.0\times10^3$ to $4.0\times10^4$, the ratio of weight-average molecular weight to number-average molecular weight (Mw/Mn) of not more than 3.5, a flow-beginning temperature in the range of from 75° to 90° C. by Flow Tester, a softening temperature in the range of from 80° to 110° C., and a glass-transition temperature (Tg) in the range of from 50° to 80° C.;

the high-temperature softening resin having a weight-average molecular weight (Mw) of from $4.0\times10^5$ to $1.5\times10^6$, the ratio of weight-average molecular weight to number-average molecular weight (Mw/Mn) of not more than 3.5, a flow-beginning temperature in the range of from 110° to 160° C. by a flow tester, a softening temperature in the range of from 150° to 230° C., and a glass-transition temperature (Tg) in the range of not lower than 40° C.;

the ratio of the low-temperature softening resin to the high-temperature softening resin being in the range of from 50:50 to 90:10 by weight; and the binder resin being prepared by dissolving and mixing the low-temperature softening resin and the high-temperature softening resin in a solvent capable of dissolving the both resins, and removing the solvent;

the releasing agent has the number-average molecular weight (Mn) of not higher than $3.0\times10^3$, the ratio of weight-average molecular weight to number-average molecular weight (Mw/Mn) of not more than 4.0, and the melting point of from 60° to 150° C., and is contained in the non-magnetic toner in an amount of from 0.1 to 20% by weight based on the binder resin.

34. The process according to claim 5, wherein the binder resin is produced by dissolving and mixing a polymer A having a weight-average molecular weight (Mw) of from $7.0\times10^3$ to $2.5\times10^4$ and a polymer B, having a weight average-molecular weight (Mw) of from $4.5\times10^5$ to $1.0\times10^6$ in a solvent capable of dissolving both of the polymer A and the polymer B and removing the solvent.

35. The process according to claim 34, wherein the polymer A is prepared by solution polymerization and the polymer B is prepared by suspension polymerization.

36. The process according to claim 5, wherein the binder resin has a THF-insoluble portion in an amount of 5% or less by weight of the binder resin.

37. The process according to claim 5, wherein the binder resin has a ratio of weight-average molecular weight to number-average molecular weight (Mw/Mn) of from 25 to 60 according to GPC molecular weight distribution measurement.

38. The process according to claim 5, wherein the binder resin comprises a styrene-acrylic copolymer.

39. The process according to claim 38, wherein the styrene-acrylic copolymer comprises a copolymer of styrene with acrylic acid or a derivative thereof.

40. The process according to claim 38, wherein the styrene-acrylic copolymer comprises a copolymer of styrene with methacrylic acid or a derivative thereof.

41. The process according to claim 5, wherein the releasing agent comprises one or more substances selected from the group consisting of paraffin wax, low molecular weight polyethylene wax, low molecular weight polypropylene wax and polyolefin waxes modified by grafting with an aromatic vinyl monomer, an unsaturated aliphatic acid or unsaturated aliphatic acid ester.

42. The process according to claim 41, wherein the releasing agent comprises a graft-modified polyolefin wax.

43. The process according to claim 5, wherein the non-magnetic toner contains one or more additives selected from the group consisting of lubricants, abradants, fluidity-imparting agents, caking-inhibitors, electroconductivity-imparting agents, fixation aids and developability-improving agents.

44. The process according to claim 5, wherein the feeding roller is made of polyurethane rubber.

45. The process according to claim 5, wherein the developer-applying blade is pressed against the developer-carrying member at a linear pressure in the range of from 3 to 250 g/cm in the direction of the axis of the sleeve to apply the developer onto the developer-carrying member.

46. The process according to claim 5, wherein the developer-applying blade is made of a material selected from the group consisting of silicone rubber, polyurethane, fluororubber and polychlorobutadiene and the developer is positively charged by means of developer-applying blade.

47. The process according to claim 5, wherein the developer-applying blade is made of styrene-butadiene rubber or nylon, and the developer is negatively charged by means of the developer-carrying blade.

48. An image forming process comprising:

(a) feeding a developer onto a developer-carrying member;

(b) applying the developer onto the developer-carrying member in a predetermined layer-thickness by pressing the developer against the developer-carrying member with a layer thickness-controlling means;

(c) forming a developed image by developing an electrostatic image formed on a latent image holding member with the developer applied on the developer-carrying member;

(d) transferring the developed image onto a recording medium; and (e) fixing the transferred developed image on the recording medium by action of heat and pressure; wherein said developer is a non-magnetic one-component type developer comprising non-magnetic toner, said non-magnetic toner containing at least a binder resin; the binder resin having a THF-soluble portion and less than 10% by weight of a THF-insoluble portion based on the binder resin, the THF-soluble portion having a molecular weight distribution curve pattern wherein a ratio of weight-average molecular weight/number-average molecular weight (Mw/Mn) is not less than 8, and at least one peak in the range of molecular weight from $3.0\times10^3$ to $4.5\times10^4$ (MA), at least one peak in the range of molecular weight from $3.8\times10^5$ to $1.0\times10^6$ (MB), and a local minimum point in the range of molecular weight from $2.0\times10^4$ to $3.8\times10^5$ (Md) are present, and peak molecular weight ratio MB/MA is from 10 to 150, and the ratio of SA:SB:Sd is 1:(0.2–0.7):(0.2–0.8), where SA is the area under the molecular weight distribution curve at the molecular weight range of 400 to Md, SB is the area under the molecular weight distribution curve at the molecular weight range of Md to $5.0\times10^6$, and Sd is the area surrounded by the molecular weight distribution curve and the straight line drawn from the peaktop at MA to the peaktop at MB.

49. The process according to claim 48, wherein the non-magnetic toner further contains a releasing agent, the releasing agent having a number-average molecular weight (Mn) not higher than $3.0\times10^3$, a weight average molecular weight (Mw) not higher than $1.2\times10^4$, and a ratio of weight-average molecular weight/number average molecular weight (Mw/Mn) not more than 4, and a melting point from 60° to 150° C. and being contained in the non-magnetic toner in an amount of from 0.1 to 20% by weight based on the binder resin.

50. The process according to claim 48, wherein the THF-soluble portion of the binder resin has a molecular weight distribution curve pattern determined by GPC in which a ratio of weight-average molecular weight-/number-average molecular weight (Mw/Mn) is not less than 18, and at least one peak in the range of molecular weight from $3.0\times10^3$ to $2\times10^4$ (MA), at least one peak in the range of molecular weight from $3.8\times10^5$ to $1.0\times10^6$ (MB), and a local minimum point in the range of molecular weight from $2.0\times10^4$ to $3.8\times10^5$ (Md) are present, and peak molecular weight ratio MB/MA being from 30 to 150, and the ratio of SA:SB:Sd is 1:(0.25–0.7):(0.3–0.8); the binder resin is produced by dissolving and mixing a polymer A having a weight-average molecular weight from $5.0\times10^3$ to $3.0\times10^4$ and a polymer B having a weight-average molecular weight from 4.0 to $10^5$ to $1.5\times10^6$ in a solvent which is capable of dissolving both of the polymer A and the polymer B and subsequently removing the solvent.

51. The process according to claim 50, wherein the non-magnetic toner further contains a releasing agent, the releasing agent has a number-average molecular weight (Mn) of not higher than $1.0\times10^3$, a weight-average molecular weight (Mw) of not higher than $1.2\times10^4$, a ratio of weight-average molecular weight to number-average molecular weight (Mw/Mn) of not more than 4.0 and a melting point in the range of from 60° to 150° C., and the releasing agent is contained in the non-magnetic toner in an amount from 0.1 to 20% by weight based on the binder resin.

52. The process according to claim 50, wherein the non-magnetic toner further contains a releasing agent, the releasing agent has a number-average molecular weight (Mn) of not higher than $1.0\times10^3$, a weight-average molecular weight (Mw) of not higher than $2.5\times10^3$, a ratio of weight-average molecular weight to number-average molecular weight (Mw/Mn) of not more than 4.0, and a melting point in the range from 60° to 150° C. and the releasing agent is contained the non-magnetic toner in an amount from 0.1 to 20% by weight based on the binder resin.

53. The process according to claim 50, wherein the non-magnetic toner further contains a releasing agent, the releasing agent has a number-average molecular weight (Mn) of not higher than $3.0\times10^3$, a weight-average molecular weight (Mw) of not higher than $7.5\times10^3$, a ratio of weight-average molecular weight to number-average molecular weight (Mw/Mn) of not more than 4.0, and a melting point in the range from 60° to 140° C. and the releasing agent is contained the non-magnetic toner in an amount of from 0.1 to 20% by weight based on the binder resin.

54. The process according to claim 48, wherein the THF-soluble portion of the binder resin has a molecular weight distribution curve pattern determined by GPC in which a ratio of weight-average molecular weight-/number-average molecular weight (Mw/Mn) is not less than 8, and at least one peak in the range of molecular weight from $1.5\times10^4$ to $4.0\times10^4$ (MA), at least one peak in the range of molecular weight from $3.8\times10^5$ to $1.0\times10^6$ (MB), and a local minimum point in the range of molecular weight from $4.0\times10^4$ to $3.8\times10^5$ (Md) are present, and peak molecular weight ratio MB/MA being from 10 to 70, and the ratio of SA:SB:Sd is 1:(0.2–0.5):(0.2–0.5); the binder resin is produced by dissolving and mixing a polymer A having a weight-average molecular weight from $2.0\times10^4$ to $6.0\times10^4$ and a polymer B having a weight-average molecular weight from 4.0 to $10^5$ to $1.5\times10^6$ in a solvent which is capable of dissolving both of the polymer A and the polymer B and subsequently removing the solvent.

55. The process according to claim 54, wherein the non-magnetic toner further contains a releasing agent, the releasing agent has a number-average molecular weight (Mn) of not higher than $3.0\times10^3$, a weight-average molecular weight (Mw) of not higher than $1.2\times10^4$, a ratio of weight-average molecular weight to number-average molecular weight (Mw/Mn) of not more than 4.0 and a melting point in the range of from 60° to 150° C., and the releasing agent is contained in the non-magnetic toner in an amount of from 0.1 to 20% by weight based on the binder resin.

56. The process according to claim 48, wherein the binder resin is produced by dissolving and mixing a polymer A having a weight-average molecular weight (Mw) from $5.0\times10^3$ to $4.0\times10^4$ and a polymer B having a weight average molecular weight (Mw) from $4.0\times10^5$ to $1.5\times10^6$ in a solvent capable of dissolving both of the polymer A and the polymer B, and removing the solvent.

57. The process according to claim 48, wherein the binder resin is produced by dissolving and mixing a polymer A having a weight-average molecular weight (Mw) of from $7.0\times10^3$ to $2.5\times10^4$ and a polymer B having a weight average-molecular weight (Mw) from $4.5\times10^5$ to $1.0\times10^6$ in a solvent capable of dissolving both of the polymer A and the polymer B, and removing the solvent.

58. The process according to claim 57, wherein the polymer A is prepared by solution polymerization and the polymer B is prepared by suspension polymerization.

59. The process according to claim 48, wherein the binder resin has a THF-insoluble portion in an amount of 5% or less by weight of the binder resin.

60. The process according to claim 48, wherein the binder resin has a ratio of weight-average molecular weight to number-average molecular weight (Mw/Mn) of not less than 12 according to GPC molecular weight distribution measurement.

61. The process according to claim 48, wherein the binder resin has a ratio of weight-average molecular weight to number-average molecular weight (MW/Mn) of from 25 to 60 according to GPC molecular weight distribution measurement.

62. The process according to claim 48, wherein the binder resin comprises a styrene-acrylic type copolymer.

63. The process according to claim 62, wherein the styrene-acrylic type copolymer comprises a copolymer of styrene with acrylic acid or a derivative thereof.

64. The process according to claim 62, wherein the styrene-acrylic type copolymer comprises a copolymer of styrene with methacrylic acid or a derivative thereof.

65. The process according to claim 49, wherein the releasing agent comprises one or more substances selected from the group consisting of paraffin wax, low molecular weight polyethylene wax, low molecular-weight ethylene-propylene copolymer, low molecular weight polypropylene wax and polyolefin waxes modified by grafting with an aromatic vinyl monomer, αn unsaturated aliphatic acid, or unsaturated aliphatic acid ester.

66. The process according to claim 65, wherein the releasing agent comprises a graft-modified polyolefin wax.

67. The process according to claim 48, wherein the non-magnetic toner contains one or more additives selected from the group consisting of lubricants, abradants, fluidity-imparting agents, caking-inhibitors, electroconducitivity-imparting agents, fixation aids, and developability-improving agents.

68. The process according to claim 48, wherein the binder resin comprises a low-temperature softening resin of styrene-acrylic type prepared by solution polymerization and a high-temperature softening resin of styrene-acrylic type prepared by suspension polymerization; the low-temperature softening resin having a weight-average molecular weight (Mw) from $5.0\times10^3$ to $6.0\times10^4$, the ratio of weight-average molecular weight to number-average molecular weight (Mw/Mn) of not more than 3.5, a flow-beginning temperature in the range from 75° to 90° C. by a flow tester, a softening temperature in the range from 80° to 110° C. and a glass-transition temperature (Tg) not lower than 40° C., being contained in the non-magnetic toner in an amount of not less than 50% by weight based on the binder resin, the high-temperature softening resin having a weight-average molecular weight (Mw) from 4.0 to $10^5$ to $1.5\times10^6$, the ratio of weight-average molecular weight to number-average molecular weight (Mw/Mn) not more than 5.0, a flow-beginning temperature in the range from 110° to 160° C. by a flow tester, a softening temperature in the range from 150° to 230° C. and a glass-transition temperature (Tg) not lower than 40° C.; the ratio of the low-temperature softening resin to the high-temperature softening resin being in the range from 50:50 to 90:10 by weight; and the binder resin being prepared by dissolving and mixing the low-temperature softening resin and the high-temperature softening resin in a solvent capable of dissolving both resins, and removing the solvent.

69. The process according to claim 68, wherein the low-temperature softening resin has a weight-average molecular weight (Mw) in the range from $7.0\times10^3$ to $2.5\times10^4$, a ratio of weight-average molecular weight to number-average molecular weight (Mw/Mn) of not more than 3.0, a flow-beginning temperature in the range from 80° to 90° C. by a flow-tester, a softening temperature in the range from 85° to 105° C. and a glass transition temperature (Tg) in the range from 55° to 70° C.

70. The process according to claim 68, wherein the high-temperature softening resin has a weight-average molecular weight (Mw) in the range from $4.5\times10^5$ to $1.0\times10^6$, a ratio of weight-average molecular weight to number-average molecular weight (Mw/Mn) of not more than 4.5, a flow-beginning temperature in the range from 115° to 150° C. by a flow tester, a softening temperature in the range from 160° to 210° C., and a glass transition temperature (Tg) in the range from 50° to 70° C.

71. The process according to claim 68, wherein the high-temperature softening resin has the ratio of weight-average molecular weight to number-average molecular weight (Mw/Mn) of not more than 4.5.

72. The process according to claim 48, wherein the latent image-supporting member is electrostatically charged by contact with a charging means, and an electrostatically charged latent image is formed on the charged image-forming member by a latent image forming means.

73. The process according to claim 48, wherein the layer thickness-controlling means is pressed against the developer-carrying member at a linear pressure in the range from 3 to 250 g/cm in the direction of the axis of the sleeve to apply the developer onto the developer-carrying member.

74. The process according to claim 48, wherein the latent image formed on the latent image-supporting member is developed with the developer applied on the developer-carrying member under application of at least an alternate current bias or a direct current bias.

75. The process according to claim 48, wherein the latent image supporting member is a photosensitive drum having a photosensitive layer containing an organic photoconductive substance.

* * * * *

UNITED STATES PATENT AND TRADEMARK OFFICE

CERTIFICATE OF CORRECTION

PATENT NO. : 5,389,487

DATED : February 14, 1995

INVENTOR : HIROAKI KAWAKAMI, ET AL.

It is certified that errors appear in the above-identified patent and that said Letters Patent is hereby corrected as shown below:

On title page, item

[56] References Cited

U.S. Patent Documents, "4,403,027 9/1983 Iskikawa et al." should read --4,403,027 9/1983 Ishikawa et al.--.

[75] Inventors:

"Masashi Jimbo" should read --Masashi Jinbo--.

COLUMN 3

Line 15, "$10^3$" should read --$10^3$,--.

COLUMN 5

Line 2, "the" should read --than--;

Line 11, "(2.0" should read --(4.5--;

Line 46, "weight" should read --weights--; and

Line 52, "weight" should read --weights--.

COLUMN 6

Line 10, "is" should be deleted;

Line 16, "satis-" should read --be satis- --; and

Line 56, "IS" should read --is--.

COLUMN 7

Line 50, "be" should be deleted.

UNITED STATES PATENT AND TRADEMARK OFFICE

CERTIFICATE OF CORRECTION

PATENT NO. : 5,389,487

DATED : February 14, 1995

INVENTOR : HIROAKI KAWAKAMI, ET AL.

It is certified that errors appear in the above-identified patent and that said Letters Patent is hereby corrected as shown below:

COLUMN 9

Line 32, "has" should read --have--.

COLUMN 10

Line 2, "intoner" should read --in toner--.

COLUMN 11

Line 21, "those" should read --one--.

COLUMN 12

Line 48, "eight" should read --weight--.

COLUMN 13

Line 57, "agent" should read --agents--.

COLUMN 14

Line 18, "Hanza" should read --Hansa--.

COLUMN 15

Line 32, "hanza" should read —Hansa—

COLUMN 17

Line 43, "is" should read --are--.

UNITED STATES PATENT AND TRADEMARK OFFICE

CERTIFICATE OF CORRECTION

PATENT NO. : 5,389,487

DATED : February 14, 1995

INVENTOR : HIROAKI KAWAKAMI, ET AL.

It is certified that errors appear in the above-identified patent and that said Letters Patent is hereby corrected as shown below:

COLUMN 18

Line 32, "includes" should read --include--;

Line 44, "a" should read --an--; and

Line 46, "toughened" should read --roughened--.

COLUMN 19

Line 57, "is" should read --are--.

COLUMN 20

Line 27, "is," should read --are--.

COLUMN 22

Line 57, "as, low" should read --as low--; and

Line 66, "above, materials," should read --above materials,--.

COLUMN 29

Line 14, "by," should read --by--.

COLUMN 31

Line 7, "2,550," should read --2,500,--.

UNITED STATES PATENT AND TRADEMARK OFFICE

CERTIFICATE OF CORRECTION

PATENT NO. : 5,389,487

DATED : February 14, 1995

INVENTOR : HIROAKI KAWAKAMI, ET AL.

It is certified that errors appear in the above-identified patent and that said Letters Patent is hereby corrected as shown below:

COLUMN 32

Line 47, "Form" should read --From--; and

Line 57, "a" should read --at--.

COLUMN 33

Line 10, "was" should read --were--; and

Line 36, "3,550" should read --3,500--.

COLUMN 41

Table 3, Example 1, "36000" should read --3600--.

COLUMN 46

"TABLE 6" should read --TABLE 12--.

COLUMN 53

Table 26, Polymer Synthesis Example 50, "cyclohexanone" should read --cyclohexane--.

COLUMN 56

Line 15, "pressure:" should read --pressure;--.

COLUMN 57

Line 34, "claim 1," should read --to claim 1,--; and

Line 65, "claim 1," should read --to claim 1,--.

UNITED STATES PATENT AND TRADEMARK OFFICE

CERTIFICATE OF CORRECTION

PATENT NO. : 5,389,487

DATED : February 14, 1995

INVENTOR : HIROAKI KAWAKAMI, ET AL.

It is certified that errors appear in the above-identified patent and that said Letters Patent is hereby corrected as shown below:

COLUMN 58

Line 28, "claim 1," should read --to claim 1,--;

Line 54, "mope" should read --more--; and

Line 59, "claim 1," should read --to claim 1,--.

COLUMN 60

Line 7, "mope" should read --more--.

COLUMN 65

Line 63, "(MW/Mn)" should read --(Mw/Mn)--.

UNITED STATES PATENT AND TRADEMARK OFFICE

CERTIFICATE OF CORRECTION

PATENT NO. : 5,389,487

DATED : February 14, 1995

INVENTOR : HIROAKI KAWAKAMI, ET AL.

It is certified that errors appear in the above-identified patent and that said Letters Patent is hereby corrected as shown below:

COLUMN 66

Line 13, "αn" should read --an--.

Signed and Sealed this

Eighteenth Day of July, 1995

*Attest:*

*Attesting Officer*

Bruce Lehman

BRUCE LEHMAN

*Commissioner of Patents and Trademarks*